US006783440B2

(12) United States Patent
Togawa et al.

(10) Patent No.: US 6,783,440 B2
(45) Date of Patent: Aug. 31, 2004

(54) POLISHING APPARATUS

(75) Inventors: Tetsuji Togawa, Chigasaki (JP); Osamu Nabeya, Chigasaki (JP)

(73) Assignee: Ebara Corporation, Tokyo (JP)

( * ) Notice: Subject to any disclaimer, the term of this patent is extended or adjusted under 35 U.S.C. 154(b) by 274 days.

(21) Appl. No.: 09/903,581

(22) Filed: Jul. 13, 2001

(65) Prior Publication Data

US 2002/0006772 A1 Jan. 17, 2002

(30) Foreign Application Priority Data

Jul. 14, 2000 (JP) ..... 2000-214218

(51) Int. Cl.[7] ..... B24B 7/00

(52) U.S. Cl. ..... 451/56; 451/164; 451/170; 451/173; 451/443

(58) Field of Search ..... 451/56, 164, 170, 451/173, 305, 297, 306, 307, 443, 446

(56) References Cited

U.S. PATENT DOCUMENTS 4,268,999 A * 5/1981 Noto et al.
5,232,875 A 8/1993 Tuttle et al.
5,456,627 A * 10/1995 Jackson et al. ..... 451/11
6,306,019 B1 * 10/2001 Finkelman ..... 451/56
6,361,413 B1 * 3/2002 Skrovan ..... 451/56
6,428,407 B1 * 8/2002 Elder ..... 451/530
6,447,374 B1 * 9/2002 Sommer et al. ..... 451/56

* cited by examiner

*Primary Examiner*—Eileen P. Morgan
(74) *Attorney, Agent, or Firm*—Wenderoth, Lind & Ponack, L.L.P.

(57) ABSTRACT

A polishing apparatus has a top ring for holding a workpiece to be polished and a polishing table movable relative to the top ring. The polishing table has a polishing surface for polishing the workpiece held by the top ring. The polishing apparatus further has a polishing liquid supply device for supplying a polishing liquid to the polishing surface. At least one of the top ring and the polishing table reciprocates linearly in a first direction. The workpiece can be polished uniformly by the polishing surface because at least one of the top ring and the polishing table reciprocates linearly in the first direction.

14 Claims, 21 Drawing Sheets

*FIG. 17*

GENERAL CHARACTERISTICS OF LINEAR MOTORS

| | LIM | LDM | LPM |
|---|---|---|---|
| CONTINUOUS OPERATION | ◎ | △ | ○ |
| INTERMITTENT OPERATION | ○ | ◎ | ◎ |
| SMALL-DISPLACEMENT RECIPROCAL MOVEMENT | △ | ◎ | ◎ |
| LARGE-DISPLACEMENT RECIPROCAL MOVEMENT | ◎ | △ | ○ |
| POSITIONING PERFORMANCE | ○ | ◎ | ◎ |
| LARGER PROPULSION | ◎ | ○ | ○ |
| LOW-SPEED OPERATION | ◎ | ○ | ◎ |
| HIGH-SPEED OPERATION | ◎ | ○ | △ |
| OPEN-LOOP CONTROLLABILITY | ○ | × | ◎ |
| VERTICAL DELIVERY | ○ | △ | ○ |
| SIMPLER CARRIAGE STRUCTURE | ◎ | △ | ○ |
| SIMPLER CONTROL POWER SUPPLY | ○ | ◎ | ○ |
| PRICE | ○ | △ | △ |
| ADAPTABILITY | LARGE-OUTPUT, CONTINUOUS TRANSPORT<br>MEDIUM AND HIGH-SPEED TRANSPORT | SMALL-DISPLACEMENT, HIGH-SPEED<br>POSITIONAL CONTROL | LOW-SPEED, HIGH-PROPULSION TRANSPORT<br>INTERMITTENT TRANSPORT<br>POSITIONAL CONTROL |

◎ : EXCELLENT ○ : GOOD △ : PROBLEMATIC × : DIFFICULT

LIM : INDUCTION MOTOR

LDM : DC MOTOR

LMP : PULSE MOTOR

CONSTANT OUTPUT FREQUENCY CONDITION

| | CONSTANT OUTPUT VOLTAGE | | VARIABLE OUTPUT VOLTAGE (HIGH EFFICIENCY) | |
|---|---|---|---|---|
| | LIGHT LOAD | HEAVY LOAD | LIGHT LOAD | HEAVY LOAD |
| VOLTAGE | | | SMALL | LARGE |
| CURRENT | SMALL | LARGE | SMALL | LARGE |
| POWER | SMALL | LARGE | SMALL | LARGE |
| POWER FACTOR | △ | ○ | ○ | ○ |

VARIABLE SPEED CONDITION
CONSTANT OUTPUT CURRENT

| | LIGHT LOAD | HEAVY LOAD |
|---|---|---|
| SPEED | HIGH | LOW |

CONSTANT SPEED CONDITION
CONSTANT OUTPUT VOLTAGE

| | LIGHT LOAD | HEAVY LOAD |
|---|---|---|
| VOLTAGE | | |
| CURRENT | SMALL | LARGE |
| POWER | SMALL | LARGE |
| POWER FACTOR | △ | ○ |

POLISHING APPARATUS

BACKGROUND OF THE INVENTION

1. Field of the Invention

The present invention relates to a polishing apparatus, and more particularly to a polishing apparatus for polishing a substrate for use in semiconductor devices.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical Polishing (CMP) in which the semiconductor wafers are chemically and mechanically polished while supplying a polishing liquid comprising abrasive particles and chemical solution such as alkaline solution.

In a manufacturing process of a semiconductor device, a thin film is formed on a semiconductor device, and then micromachining processes, such as patterning or forming holes, are applied thereto. Thereafter, the above processes are repeated to form thin films on the semiconductor device. Recently, semiconductor devices have become more integrated, and the structure of semiconductor elements has become more complicated. In addition, the number of layers in multilayer interconnections used for a logical system has been increased. Therefore, irregularities on the surface of the semiconductor device are increased, so that the step height on the surface of the semiconductor device becomes larger.

When the irregularities of the surface of the semiconductor device are increased, the following problems arise. The thickness of a film formed in a portion having a step is relatively small. An open circuit is caused by disconnection of interconnections, or a short circuit is caused by insufficient insulation between the layers. As a result, good products cannot be obtained, and the yield is lowered. Further, even if a semiconductor device initially works normally, reliability of the semiconductor device is lowered after a long-term use.

Thus, in the manufacturing process of a semiconductor device, it is increasingly important to planarize the surface of the semiconductor device. The most important one of the planarizing technologies is chemical mechanical polishing (CMP). In the chemical mechanical polishing, a polishing apparatus is employed. While a polishing liquid containing abrasive particles such as silica ($SiO_2$) therein is supplied onto a polishing surface such as a polishing pad, a substrate such a semiconductor wafer is brought into sliding contact with the polishing surface, so that the substrate is polished.

FIG. 23 of the accompanying drawings show a conventional polishing apparatus for carrying out a CMP process. As shown in FIG. 23, a polishing apparatus 101 having a belt has been used, in addition to a rotary apparatus with a rotatable polishing pad, for planarizing a device surface of a semiconductor wafer W. The polishing apparatus 101 has a flexible endless belt 102 with a resilient polishing pad 105 applied to an outer surface thereof. The belt 102 is wound onto a pair of rollers 103, 104 that rotate about their own axes. A backup plate 109 is positioned along a straight stretch of the belt 102 between the rollers 103, 104 and held against the reverse side of the belt 102. The polishing apparatus 101 has a rotatable top ring 108 disposed in confronting relation to the belt 102 held by the backup plate 109. The top ring 108 presses the semiconductor wafer W against the polishing pad 105 on the belt 102.

In the conventional polishing apparatus having the above structure, the polishing pad 105 applied to the flexible endless belt 102 cannot easily be replaced with a new one. The resilient polishing pad 105 tends to cause polishing in recesses of the semiconductor wafer W to progress, this phenomenon being called "dishing". Attempts to use a fixed abrasive to prevent dishing have been unsuccessful because the belt 102 is flexible.

SUMMARY OF THE INVENTION

It is therefore an object of the present invention to provide a polishing apparatus which has a polishing pad that can be replaced easily and which allows a fixed abrasive to be used with ease.

In order to achieve the above object, according to the present invention there is provided a polishing apparatus comprising: a top ring for holding a workpiece to be polished; and a polishing table movable relatively to the top ring, the polishing table having a polishing surface for polishing the workpiece held by the top ring; wherein at least one of the top ring and the polishing table reciprocates linearly in a first direction.

The workpiece typically comprises a semiconductor wafer for manufacturing semiconductor devices.

According to the present invention, the polishing table is movable relatively to the top ring for polishing the workpiece held by the top ring, and at least one of the top ring and the polishing table reciprocates linearly in the first direction, and hence the workpiece can be polished uniformly.

In a preferred aspect, the polishing apparatus further comprises a polishing liquid supply device for supplying a polishing liquid to the polishing surface. The polishing liquid supply device comprises a fluid passage formed in the polishing table for supplying the polishing liquid to the polishing surface. The polishing liquid typically comprises an abrasive liquid containing abrasive particles, but may comprise pure water.

In a preferred aspect, the polishing apparatus further comprises a dresser which reciprocates linearly in a second direction for dressing the polishing surface. The second direction typically intersects the first direction, and preferably perpendicularly to the first direction. The second direction may be in conformity with the first direction, allowing the dresser to sweep debris off the polishing surface.

Since the dresser reciprocates linearly in the second direction, it can dress the polishing surface uniformly.

In a preferred aspect, a plurality of the dressers are provided in combination with the top ring.

The dressers may be of different types and may selectively be used for dressing the polishing surface differently. If the dressers are disposed one on each side of the top ring, then the distance that the polishing table reciprocates linearly in the first direction for being dressed by the dressers may be reduced, thus making the polishing apparatus smaller in size.

The top ring preferably reciprocates linearly in a third direction intersecting the first direction. The third direction is typically the same as the second direction.

Inasmuch as the top ring reciprocates linearly in the third direction intersecting the first direction, the workpiece can be polished uniformly without using the polishing surface locally.

In a preferred aspect, the top ring is arranged to rotate the workpiece held thereby with respect to the polishing table. The top ring should be rotated at a speed up to 10 revolutions per minute. Because the top ring rotates the workpiece held thereby with respect to the polishing table, the surface, being polished, of the workpiece is prevented from being locally scratched or damaged.

The polishing surface should preferably have a groove formed therein for discharging a waste material from the polishing surface. The waste material includes ground-off material produced when the workpiece is polished, and the used polishing liquid. The groove is typically arranged to eject a cleaning liquid or draw the waste material under vacuum.

The polishing table may have a plurality of polishing surfaces having different levels of coarseness. One of the polishing surfaces may comprise a fixed abrasive. Particularly, one of the polishing surfaces which is used to roughly polish the workpiece should comprise a fixed abrasive.

With the polishing table which comprises a plurality of polishing surfaces having different levels of coarseness, the polishing table is capable of polishing the workpiece under conditions that are suitable for the shape and properties of the surface, to be polished, of the workpiece.

In a preferred aspect, the polishing apparatus further comprises a linear motor for reciprocating linearly at least one of the top ring and the polishing table in the first direction.

Preferably, the polishing table is arranged to reciprocate linearly in the first direction, and the polishing apparatus further comprises a linear guide supporting the polishing table under a fluid pressure.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 17 is a table of general characteristics of linear motors;

DETAILED DESCRIPTION OF THE PREFERRED EMBODIMENTS

Figure 1A:
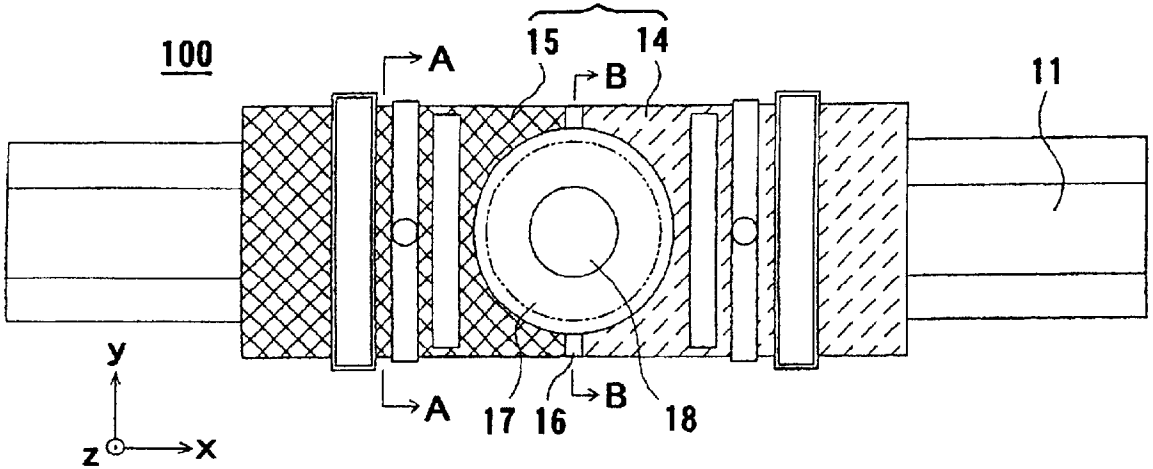
FIGS. 1A and 1B are a plan view and a front elevational view, respectively, of a polishing apparatus according to a first embodiment of the present invention.

A polishing apparatus according to embodiments of the present invention will be described below with reference to drawings. In FIGS. 1 through 22, like or corresponding parts are denoted by like or corresponding reference numerals throughout views, and repetitive description is eliminated.

Figure 1B:
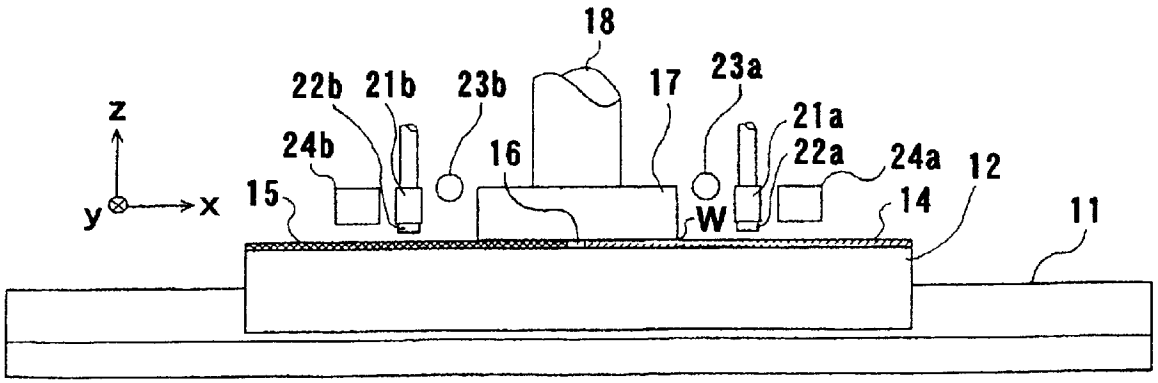
Figure 2:
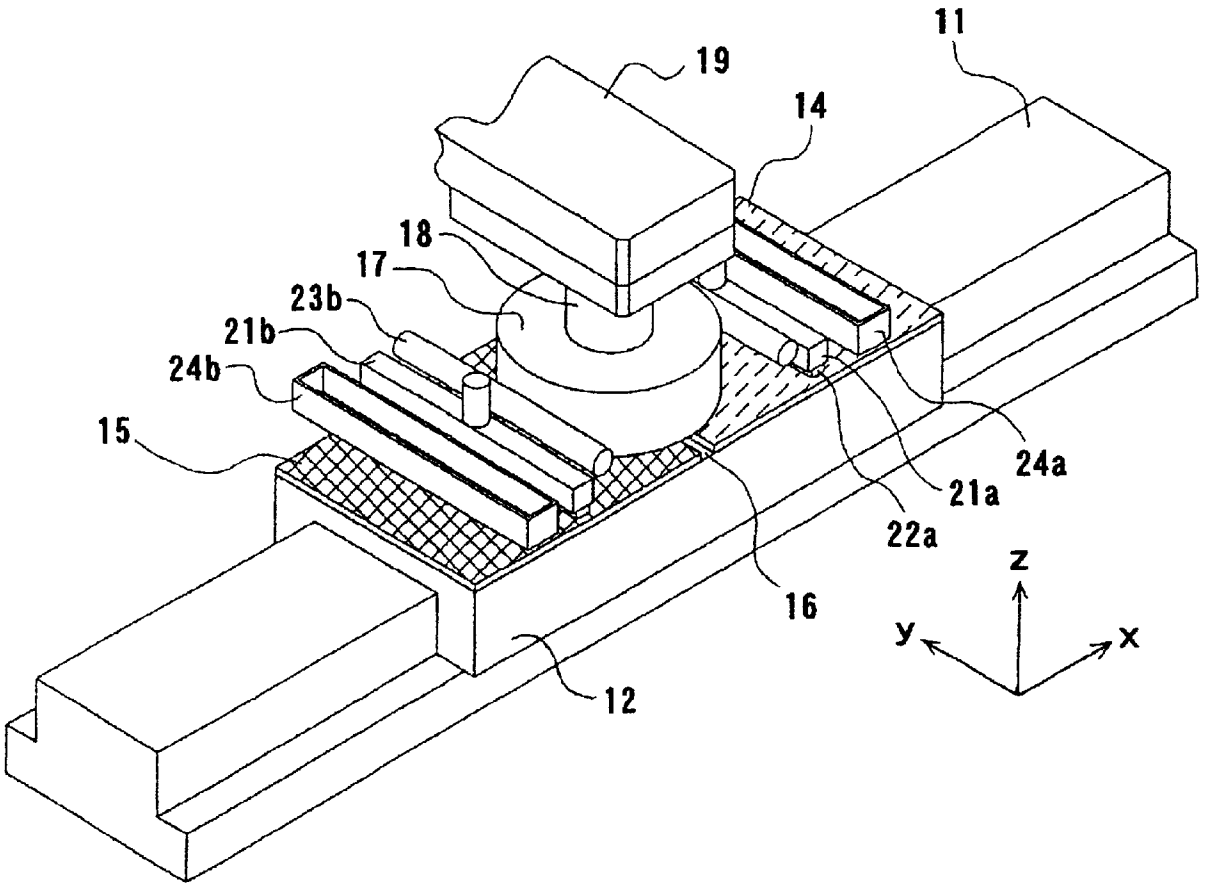
FIG. 2 is a perspective view of the polishing apparatus shown in FIGS. 1A and 1B.

FIGS. 1A, 1B and 2 show a polishing apparatus according to a first embodiment of the present invention.

FIGS. 1A and 1B show, in plan and front elevation, a linear polishing apparatus 100 as a polishing apparatus according to a first embodiment of the present invention. As shown in FIGS. 1A and 1B, the linear polishing apparatus 100 has a guide rail 11 as a linear guide having a horizontal guide surface, and a polishing table 12 which is mounted on the horizontal guide surface of the guide rail 11 and reciprocates along the guide rail 11 in a horizontal direction.

FIG. 2 shows the linear polishing apparatus 100 in perspective. An xyz orthogonal coordinate system is established such that the x axis is in a direction along the guide rail 11, the y axis is in a horizontal plane perpendicular to the x axis, and the z axis is in a vertical direction perpendicular to the x and y axes. A first direction according to the present invention corresponds to the direction along the x axis.

The polishing table 12 has an upper surface serving as a polishing surface 13 lying in the horizontal plane. The polishing surface 13 is divided into a coarse rough polishing surface 14 and a fine finish polishing surface 15, and has a linear multifunctional groove 16 defined between the rough polishing surface 14 and the finish polishing surface 15 and extending in the direction (y axis) perpendicular to the direction (x axis) of linear movement along the guide rail 11. If it is not necessary to distinguish the rough polishing surface 14 and the finish polishing surface 15 from each other in the following explanation, the polishing surface will be referred to as the polishing surface 13.

While the polishing surface 13 comprises two polishing surfaces, i.e. the rough polishing surface 14 and the finish polishing surface 15 in the present embodiment, the polishing surface 13 may comprise three or more polishing surfaces. For example, the polishing surface 13 may include a reforming surface for reforming the surface of a semiconductor wafer for the purpose of increasing a cleaning effect, in addition to the rough polishing and the finish polishing.

The linear polishing apparatus 100 comprises a top ring 17, having a thick disk shape and disposed above the polishing surface 13, for holding a circular semiconductor wafer W and pressing the semiconductor wafer W against the polishing surface 13. A pressing mechanism 18 is mounted on the upper portion of the top ring 17 remote from the holding surface of the top ring 17 which holds the semiconductor wafer W. The pressing mechanism 18 serves to rotate the top ring 17 about its axis in a horizontal plane. The pressing mechanism 18 also serves to move the top ring 17 in a horizontal direction perpendicular to the direction (x axis) of linear movement of the polishing table 12 along the guide rail 11, and to press the top ring 17 against the polishing pad 13. The pressing mechanism 18 is movable by an arm 19 (see FIG. 2).

The polishing apparatus 100 further comprises a pair of dressers 21*a*, 21*b* disposed adjacent to the top ring 17 along the x axis for dressing the polishing surface 13. The dressers 21*a*, 21*b* are positioned symmetrically with respect to the top ring 17. The dressers 21*a*, 21*b* have dresser elements 22*a*, 22*b* at lower surfaces thereof, respectively so as to face the polishing surface 13. The dressers 21*a*, 21*b* and the dresser elements 22*a*, 22*b* mounted on the respective lower surfaces of the dressers 21*a*, 21*b* are of an elongate rectangular shape. The dresser elements 22*a*, 22*b* have a longitudinal axis extending along the y axis. Nozzles 23*a*, 23*b* for supplying a liquid to the dressers 21*a*, 21*b* are disposed between the top ring 17 and the dressers 21*a*, 21*b*, respectively.

Dresser receptacles 24*a*, 24*b* having elongate rectangular shape are disposed adjacent to the respective dressers 21*a*, 21*b* remotely from the nozzles 23*a*, 23*b*. Each of the dresser receptacles 24*a*, 24*b* has a longitudinal axis extending along the y axis.

Unless two identical components such as the dressers 21*a*, 21*b* need to be distinguished from each other, they will collectively be referred to as the dresser 21 without the suffixes "a", "b".

Operation of the polishing apparatus 100 will be described below with reference to FIGS. 1A, 1B and 2.

When a polishing process is conducted, the semiconductor wafer W which is held under vacuum suction with its surface, to be polished, being directed downwardly is pressed against the polishing surfaces 14, 15 that reciprocate linearly along the x axis.

The top ring 17 reciprocates linearly along the y axis perpendicular to the direction (x axis) of the linear reciprocating motion of the polishing surfaces 14, 15. A third direction according to the present invention extends along the y axis. In order to prevent the surface to be polished from being locally scratched or damaged, the top ring 17 is rotated about its own axis at a low speed up to about 10 revolutions/min. Since the top ring 17 is rotated at such a low speed, the surface, to be polished, of the semiconductor wafer W is essentially linearly moved with respect to the polishing surface 13. In other words, the top ring 17 is rotated at such a low speed that the surface, to be polished, of the semiconductor wafer W is essentially linearly moved with respect to the polishing surface 13.

Generally, the surface, to be polished, of the semiconductor wafer which is held at rest and pressed against the polishing surface 13 that reciprocates linearly is theoretically uniformly polished, because all points on the surface to be polished are moved at the same speed relatively to the polishing surface 13. In the present embodiment, furthermore, since the surface to be polished is rotated at a very low speed, it is uniformly polished and also prevented from being locally scratched or damaged.

The polishing surfaces 14, 15 have a plurality of apertures (not shown in FIGS. 1A, 1B, and 2) formed therein for discharging a polishing liquid to supply the polishing liquid directly to an interface between the polishing surfaces 14, 15 and the semiconductor wafer W. Although the linear reciprocating motion of the polishing surface 13 makes it more difficult to supply a slurry (polishing liquid) than rotary motion thereof, because the polishing liquid is supplied in the above manner, the polishing liquid can be uniformly supplied over the entire surface, to be polished, of the semiconductor wafer.

In order to roughly polish the semiconductor wafer W with the polishing surface 14, the polishing table 12 makes linear reciprocating motion along the x axis in such a range as to cause the polishing surface 14 alone to polish the semiconductor wafer W. For polishing the semiconductor wafer W with the polishing surface 15, the polishing table 12 makes linear reciprocating motion along the x axis in such a range as to cause the polishing surface 15 alone to polish the semiconductor wafer W. In this manner, the semiconductor wafer W can be polished to different polishing levels on the same polishing table 12.

Each of the polishing surfaces 14, 15 may comprise a polishing pad such as a polishing cloth. Since the polishing table 12 is constructed to reciprocate, either one or both of the polishing surfaces 14, 15 may comprise a fixed abrasive to prevent the surface to be polished from suffering dishing.

The upper surface of the polishing table 12 may be a rectangular flat surface having a certain extent, differently from the endless belt, and hence the polishing pad can be easily replaced.

Generally, in a polishing apparatus with a polishing pad, the polishing liquid is supplied to an interface between the workpiece to be polished and the polishing pad. Since the polishing pad is resilient, even when the workpiece is polished under a uniform pressure, both protrusions and recesses on the surface, to be polished, of the workpiece are polished. Specifically, when polishing of the protrusions is completed, polishing of the recesses has progressed. Such recesses remaining after polishing are called dishing. One solution to increase a polishing rate is to increase a pressing force applied to the workpiece. However, since the problem of dishing becomes distinct with using the polishing pad, it is difficult to achieve both the increased polishing rate and the highly planarized surface of the workpiece.

However, in the case where the fixed abrasive is used for the polishing surfaces as in the embodiment of the present invention, both the increased polishing rate and the highly planarized surface of the semiconductor wafer W can be achieved simultaneously. Particularly, it is desirable that the polishing surface 14 for roughly polishing the semiconductor wafer W comprises a fixed abrasive. The fixed abrasive may comprise particles of $CeO_2$, silica, alumina, SiC, or diamond embedded in a binder, so that the polishing surface can polish the semiconductor wafer W while not a polishing liquid containing abrasive particles but a polishing liquid containing no abrasive particles is being supplied thereto.

It is desirable that any grooves formed in the polishing surface 14 or the polishing surface 15 run fully thereacross, and extend perpendicularly to the direction of motion of the polishing surface (the x axis) or obliquely to the x axis in order to promote discharging of the polishing liquid that is no longer necessary or to prevent the polishing cloth from being peeled off.

In some cases, two polishing levels, i.e. a rough polishing and a finish polishing are required in one polishing cycle in order to polish the workpiece efficiently. Conventionally, since the polishing surfaces are provided in separate locations to achieve these multi-polishing levels, the necessity for various polishing surfaces leads to an increased installation space for the polishing apparatus. According to the present embodiment, however, since the polishing surface 13 comprises the coarse rough polishing surface 14 and the fine finish polishing surface 15, the polishing apparatus 100 does not require a large installation space and can polish the semiconductor wafer W efficiently.

With the fixed abrasive and the polishing cloth selectively provided on the polishing table 12, the workpiece can be polished under polishing conditions that are suited to the shape and properties of the surface to be polished, thus improving the polishing accuracy. Because the single polishing table 12 has at least two polishing surfaces of the same type or different types, the polishing apparatus 100 has an increased polishing capability per unit installation area and allows desired polishing processes to be performed with increased freedom.

A dressing process for dressing the polishing surfaces 14, 15, removing foreign matter from the polishing surfaces 14, 15, and regenerating the polishing surfaces 14, 15 will be described below. The dresser elements 22*a*, 22*b* may be made of a hard material such as diamond or a soft material such as nylon brush. In the dressing process, the dresser elements 22*a*, 22*b* are pressed against the polishing surfaces 14, 15 that make linear reciprocating motion along the x axis.

The dressers 21*a*, 21*b* make linear reciprocating motion along the y axis perpendicular to the x axis along which the polishing surfaces 14, 15 reciprocate. A second direction according to the present invention corresponds to the direction along the y axis. By providing the dressers 21*a*, 21*b* that make linear reciprocating motion perpendicular to the linear reciporcating motion of the polishing surfaces 14, 15, the polishing surfaces 14, 15 can be dressed uniformly in their entirety.

In the dressing process, a dressing liquid is supplied from the nozzles 23*a*, 23*b* disposed near the dressers 21*a*, 21*b* to the polishing surfaces 14, 15 for thereby removing floating foreign matter from the polishing surfaces 14, 15.

Because the dressers 21*a*, 21*b* are disposed one on each side of the top ring 17, the distance that the polishing surfaces 14, 15 reciprocate linearly along the x axis for being dressed may be relatively short, thus permitting the polishing apparatus 100 to be small in size. The length of the elongate dressers 21*a*, 21*b* and the dresser elements 22*a*, 22*b* should preferably be larger than the width of the polishing table 12 for uniformly dressing the polishing surfaces 14, 15.

If the top ring 15 is clogged with foreign matter, the polishing capability is adversely affected. In order to avoid this drawback, the polishing apparatus 100 operates in a latter part of the dressing process in the following manner: When an end of the polishing table 12 moves away from the dressers 21*a*, 21*b*, the dressers 21*a*, 21*b* are spaced from the polishing surfaces 14, 15. When the end of the polishing table 12 moves toward the dressers 21*a*, 21*b*, the dressers 21*a*, 21*b* are held against the polishing surfaces 14, 15 to discharge foreign matter toward the end of the polishing table 12 away from the multifunctional groove 16. In this case, the foreign matter can be discharged completely from the polishing table 12 by moving the polishing table 12 to a position where the dressers 21*a*, 21*b* are displaced off the polishing table 12. The foreign matter collected by the dressers 21*a*, 21*b* may be discharged by the use of the multifunctional groove 16 with its discharging function.

When the polishing surfaces 14, 15 are not dressed, the dressers 21*a*, 21*b* are placed in a standby position spaced from the polishing surfaces 14, 15 by a lifting and lowering mechanism. The nozzles 23*a*, 23*b* are positioned such that they can supply a rinsing liquid to the dresser elements 22*a*, 22*b* that are in the standby position.

The rectangular dressers 21*a*, 21*b* have their longitudinal axes extending along the y axis and reciprocate linearly in the second direction extending along the y axis. However, the dressers 21*a*, 21*b* may reciprocate linearly in any direction which intersects the x axis. However, the second direction should preferably be in the same direction as the multifunctional groove 16. The third direction along which the top ring 17 reciporcates linearly has been described as being along the y axis, but may be in any direction which intersects the x axis.

Figure 3A:
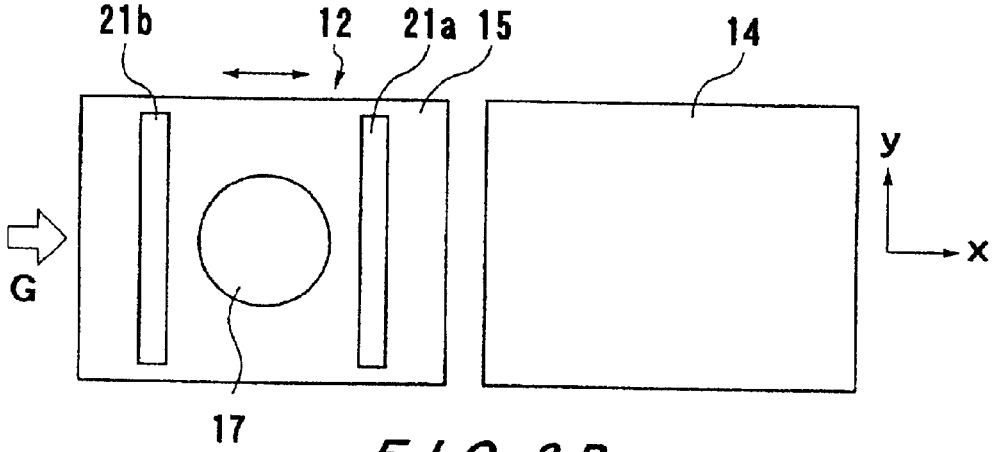
FIGS. 3A, 3B, and 3C are plan views of layouts of dressers, and a front elevational view of dressers.

A plurality of layouts of dressers will be described below with reference to FIGS. 3A through 3C. FIG. 3A shows a top ring 17 and two dressers 21*a*, 21*b* that are positioned over the polishing surface 15. Although not shown in the drawing, a top ring and two dressers are similarly positioned over the polishing surface 14.

In FIG. 3A, the two rectangular dressers 21*a*, 21*b* are disposed one on each side of the top ring 17 along the x axis and have the longitudinal axis extending along the y axis. The dressers 21*a*, 21*b* are of an identical structure. The two dressers 21*a*, 21*b* having the identical structure can dress the entire polishing surface 15 when the polishing table 12 is moved by a distance which is one half of the distance that the polishing table 12 is moved with one dresser. Therefore, the polishing apparatus 100 may be relatively small in size.

In the explanation of FIG. 3A, the dressers 21*a*, 21*b* are of an identical structure. However, as shown in FIG. 3C, the dressers 21*a*, 21*b* may be different dressers DR-A, DR-B, respectively. The different dressers DR-A, DR-B can provide a combination of different dressing effects on one polishing surface.

The dresser DR-A comprises a linear array of dressing element mounted on a surface thereof for uniformly dressing the entire polishing surface 15. The dressers DR-B may include a dresser DR-B1 having two regions of dressing element on opposite end surfaces thereof, and a central region free of dressing element, and a dresser DR-B2 having a convex dressing surface which comprises a central projecting region and two retracted opposite end regions of dressing element.

In the linear polishing apparatus 100, the polishing surface is more frequently used for polishing the workpiece at its central region than its opposite end regions, and tends to be worn to a more concave shape at its central region. Therefore, the polishing surface 13 should be dressed by the dresser DR-B1. If the opposite ends of the polishing surface 13 are worn excessively, then it should be dressed by the dresser DR-B2 having a convex dressing surface. The polishing surface can be returned to its flat shape using these different dressers.

Figure 3B:
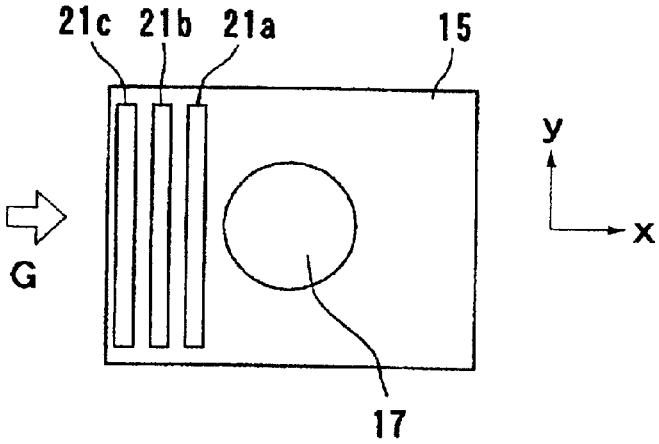
Figure 3C:
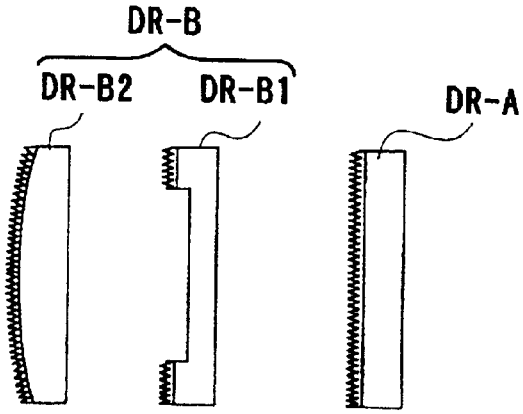

In FIG. 3B, a plurality of (three) dressers 21*a*, 21*b* and 21*c* are disposed on one side of the dresser 17 along the x axis. The dressers 21*a*, 21*b* and 21*c* are of an elongate rectangular shape and have their longitudinal axes extending along the y axis. The dresser 21*a*, which is closest to the top ring 17, comprises the dresser DR-A for uniformly dressing the entire polishing surface 15. The central dresser 21*b* comprises the dresser DR-B for dressing the polishing surface 15 locally.

The dresser 21*c*, which is remotest from the top ring 17, comprises an atomizer DR-C for spraying a mixture of water and nitrogen. The dresser (atomizer) DR-C serves to separate ground-off material and abrasive particles, embedded in the polishing surface, out from the polishing surface 15. The dresser 21*c* may comprise a nylon brush having a function for sweeping the separated ground-off material and abrasive particles out of the polishing surface.

With the dressers 21*a*, 21*b* disposed one on each side of the top ring 17, the dressing surfaces of the dressers 21*a*, 21*b* may be made of the same material and shape, and may reciprocate linearly over a short distance for dressing the polishing surface 15. Alternatively, the dressers 21*a*, 21*b* may be made of different materials so that one of the dressers is used to dress the entire area of the polishing surface 15 and the other is used to dress a local area of the polishing surface 15.

Figure 4:
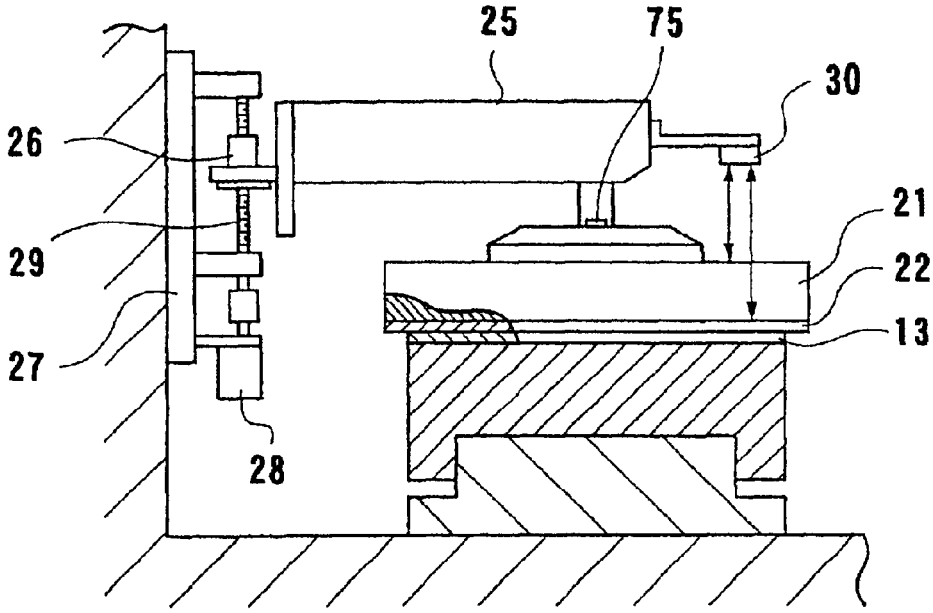
FIG. 4 is a cross-sectional view taken along line A—A of FIG. 1A.

A process of controlling the pressure of the dresser 21 which is pressed against the polishing surface 13 will be described below with reference to FIG. 4. The pressure of the dresser 21 which is pressed against the polishing surface 13 is greatly related to the dressing performance of the dresser 21. An arm 25 is attached to the dresser 21 and serves to move the dresser 21 vertically to press the dresser 21 or the dresser element 22 against the polishing surface 13. A female screw 26 with a vertical axis is mounted on an end of the arm 25 remotely from the dresser 21.

The polishing apparatus 100 has a stationary base on which a feed screw mechanism table 27 is fixedly mounted. The feed screw mechanism table 27 supports thereon an AC servomotor 28 whose output shaft is coupled to a male screw 29 threaded in the female screw 26.

A distance measuring sensor 30 is fixedly mounted on the arm 25 for detecting the vertical distance between the arm 25 and the dresser 21 or the dresser element 22 and also the vertical distance between the arm 25 and the polishing surface 13. The distance measuring sensor 30 produces an output signal that is fed back to the AC servomotor 28 either via a regulator (not shown), or directly.

The AC servomotor 28, the male screw 29, and the female screw 26 jointly make up a lifting and lowering mechanism.

The lifting and lowering mechanism operates as follows: In each dressing cycle, the distance between the polishing surface 13 and the dresser 21 or the dresser element 22 is measured by the sensor 30, and the output signal from the sensor 30 is fed back as pulses representing an error with respect to a desired distance to the AC servomotor 28 so that the established pressing amount is obtained. By this feedback control, the AC servomotor 28 is energized by the supplied pulses to thus correct the pressing amount of the dresser 21.

The AC servomotor 28, the male screw 29, and the female screw 26 may be replaced with another lifting and lowering mechanism comprising a combination of an air cylinder/piston and an air pressure regulator for keeping the pressure of the dresser 21 pressed against the polishing surface 13 constant.

Alternatively, a load cell 75 may be installed in a link by which the dresser 21 and the arm 25 are connected to each other. The load cell 75 measures a load applied to the dresser 21, and the measured load is fed back to the AC servomotor 28 or the air pressure regulator.

Figure 5:
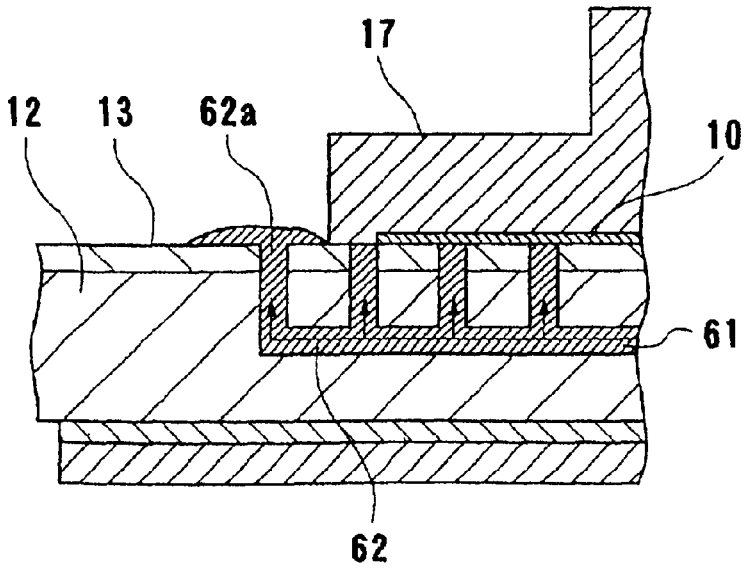
FIG. 5 is an enlarged vertical cross-sectional view of a structure for supplying a polishing liquid in the polishing apparatus shown in FIGS. 1A and 1B.

FIG. 5 shows a structure for directly supplying a polishing liquid 61 to the polishing surface 13 and the surface, to be polished, of a workpiece 10. The polishing table 12 has a polishing liquid line 62 disposed therein and communicating with a plurality of polishing liquid supply holes 62*a* formed in the polishing surface 13. The top ring 17 for holding the workpiece 10 is disposed above the polishing surface 13 in confronting relation thereto. The polishing liquid supply holes 62*a* are positioned in a distribution corresponding to the surface, to be polished, of the workpiece 10.

The polishing liquid 61 flows through the polishing liquid line 62 and is supplied from the polishing liquid supply holes 62*a* to an interface between the polishing surface 13 and the surface, to be polished, of the workpiece 10 that is held by the top ring 17. Because the polishing liquid supply holes 62*a* are positioned in a distribution corresponding to the surface, to be polished, of the workpiece 10, the polishing liquid 61 is uniformly supplied to the surface, to be polished, of the workpiece 10.

Figure 6B:
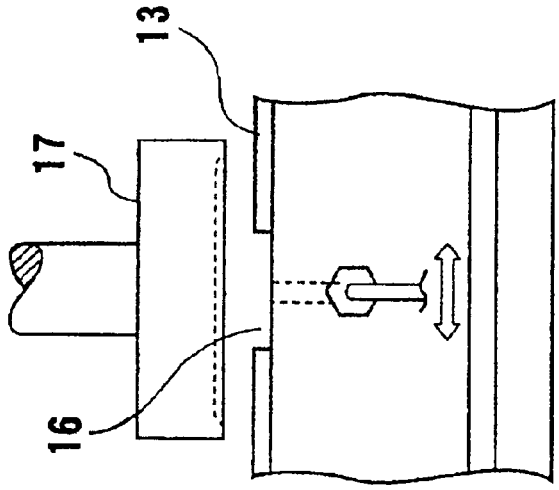
FIG. 6B is an elevational view as viewed in the direction of the arrow C in FIG. 6A.
Figure 6A:
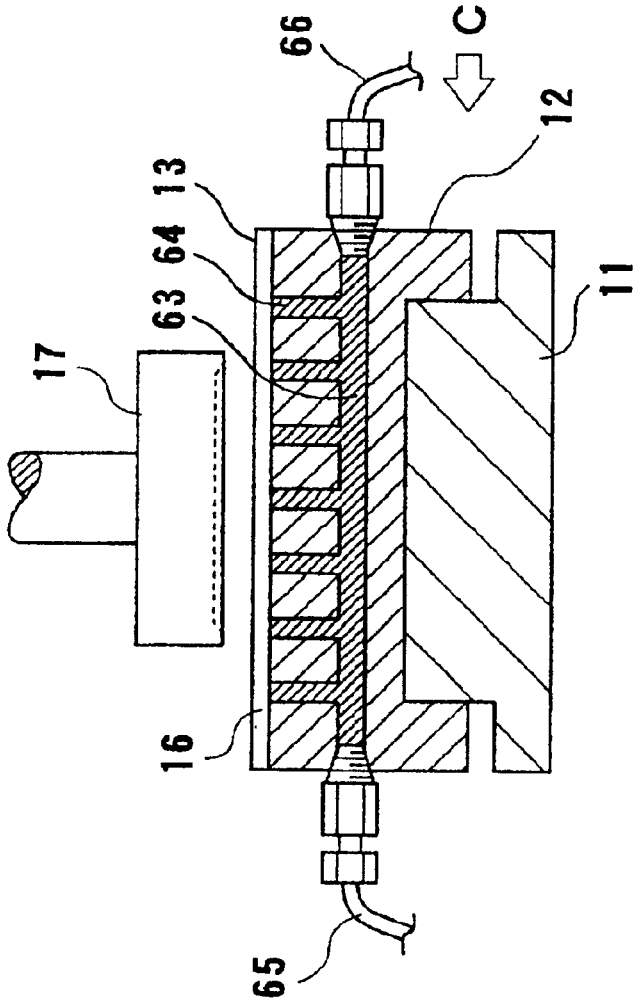
FIG. 6A is a cross-sectional view taken along line B—B of FIG. 1A, showing multifunctional grooves in the polishing apparatus shown in FIGS. 1A and 1B.

The multifunctional groove 16 formed in the polishing surface 13 will be described below with reference to FIGS. 6A and 6B. The multifunctional groove 16 is formed as a linear groove of rectangular cross section in a portion of the polishing table 12. The multifunctional groove 16 divides the polishing surface 13 into the polishing surface 14 and the polishing surface 15.

The multifunctional groove 16 should preferably have an angle to the x axis, typically extends along the y axis perpendicular to the x axis, and have opposite ends reaching the ends of the polishing table 12. The angle of the multifunctional groove 16 to the x axis should preferably be the same as the angle of the longitudinal axis of the dressers 21*a*, 21*b* to the x axis or as the direction of linear reciprocating motion of the dressers 21*a*, 21*b*. Typically, the dressers 21*a*, 21*b* reciprocate linearly along their longitudinal axes.

In the illustrated embodiment, the multifunctional groove 16 extends along the y axis. A through hole 63 is formed in the polishing table 12 below the multifunctional groove 16 and extends in parallel to the multifunctional groove 16. The through hole 63 extends from one end of the polishing table 12 to the other end thereof. The through hole 63 and the multifunctional groove 16 are connected to each other by a plurality of openings 64.

A cleaning liquid line 65 is connected to one end of the through hole 63, and a vacuum line 66 is connected to the other end of the through hole 63.

With the above arrangement, when the dressers 21 or the dresser elements 22 (not shown in FIG. 6), the polishing surface 13, and the top ring 17 are cleaned, a cleaning liquid is supplied from the cleaning liquid line 65 through the through hole 63 into the openings 64, and then ejected toward the multifunctional groove 16.

When the cleaning liquid, the polishing liquid, and foreign matter trapped in the multifunctional groove 16 are removed, a vacuum is developed in the opening 64 via the vacuum line 66 and the through hole 63 for thereby positively discharging the cleaning liquid, the polishing liquid, and the foreign matter from the polishing surface 13.

The through hole 63 and the openings 64 may be provided independently for the cleaning liquid line 65 and the vacuum line 66, thereby simultaneously introducing the cleaning liquid and discharging the unwanted liquids and foreign matter under vacuum suction. Alternatively, the through hole 63 may be connected to a polishing liquid discharge pipe, or the cleaning liquid line 65 may double as a polishing liquid discharge line for supplying the polishing liquid from the openings 64.

Figure 7:
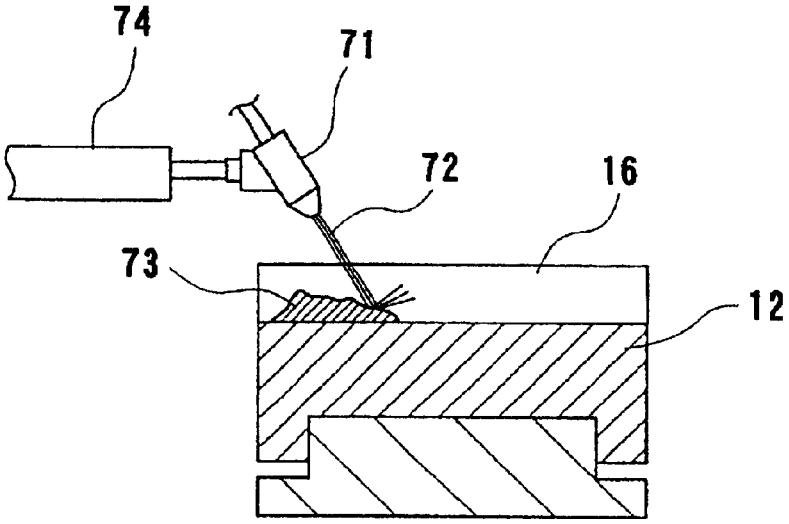
FIG. 7 is a cross-sectional view of a structure for removing foreign matter from the multifunctional grooves shown in FIG. 6A.

A structure for removing foreign matter from the multifunctional groove 16 will be described below with reference to FIG. 7. In FIG. 7, the multifunctional groove 16 is shown in longitudinal cross section along the y axis. Foreign matter which cannot be discharged under vacuum suction is gradually accumulated in the multifunctional groove 16. The accumulated foreign matter needs to be removed as it will adversely affect the polishing performance of the polishing apparatus 100. A jet nozzle 71 is used to remove the accumulated foreign matter from the multifunctional groove 16. The jet nozzle 71 is mounted on a piston slidably movable in a cylinder 74 whose longitudinal axis extends horizontally. The jet nozzle 71 ejects a high-pressure liquid 72 at a high speed.

The liquid 72 ejected from the jet nozzle 71 is applied to accumulated foreign matter 73 in the multifunctional groove 16, and removes the accumulated foreign matter 73 from the multifunctional groove 16. Since the jet nozzle 71 can be moved in the longitudinal direction of the multifunctional groove 16 by the piston in the cylinder 74, the jet nozzle 71 can apply the liquid 72 along the entire length of the multifunctional groove 16. The jet nozzle 71 is positioned, with respect to the direction in which the polishing table 12 is moved, by moving the polishing table 12 itself.

The jet nozzle 71 may be replaced with a nylon brush or the like for removing the accumulated foreign matter 73 from the multifunctional groove 16 by physical contact therewith. An ultrasonically vibrated liquid, rather than a high-pressure liquid, may be ejected from the jet nozzle 71. Since the ultrasonically vibrated liquid can be used to clean the polishing surface and remove the foreign matter therefrom, it is desirable that the ultrasonically vibrated liquid can be also supplied to the polishing surface.

Other layouts of multifunctional grooves will be described below with reference to FIGS. 8A through 10C. In the above embodiment, the single multifunctional groove is provided to separate the two polishing surfaces from each other. However, a plurality of multifunctional grooves may be formed in one polishing surface.

Figure 8A:
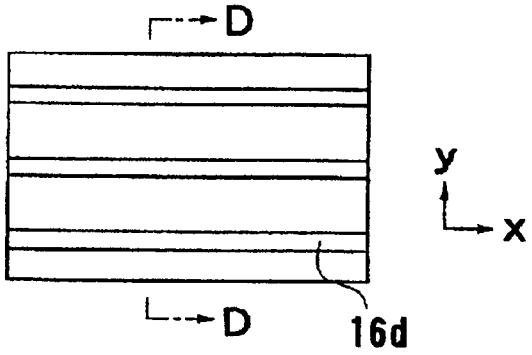
FIG. 8A is a plan view of a polishing surface having a plurality of multifunctional grooves formed therein.
Figure 8B:
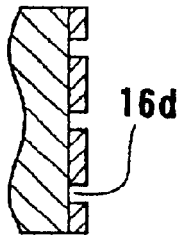
FIG. 8B is a cross-sectional view taken along line D—D of FIG. 8A.

FIGS. 8A and 8B show a plurality of (three) multifunctional grooves 16*d* formed in a polishing surface. The multifunctional grooves 16*d* extend in the first direction, i.e. along the x axis, and are spaced at equal intervals.

Figure 9A:
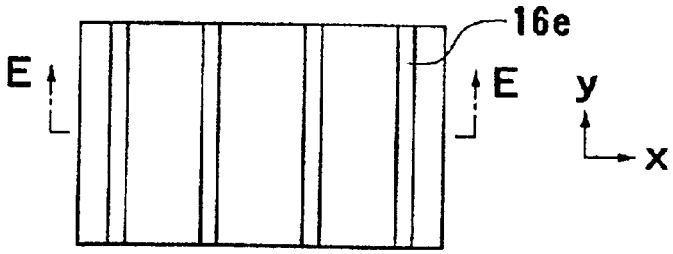
FIG. 9A is a plan view of another polishing surface having a plurality of multifunctional grooves formed therein.
Figure 9B:
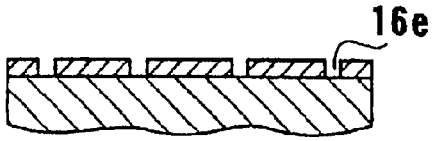
FIG. 9B is a cross-sectional view taken along line E—E of FIG. 9A.
Figure 9C:
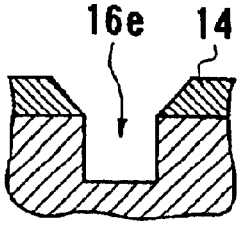
FIG. 9C is an enlarged fragmentary cross-sectional view of one of the grooves shown in FIG. 9B.

FIGS. 9A through 9C show a plurality of (four) multifunctional grooves 16*e* formed in a polishing surface. The multifunctional grooves 16*e* extend in the direction, i.e. along the y axis perpendicular to the first direction, and are spaced at equal intervals. As shown in FIG. 9C, the polishing surface 14 (polishing cloth or grinding stone) along each of the multifunctional grooves 16*e* may have beveled corners to reduce damage of the semiconductor wafer caused by the polishing surface 14. The beveled corners may be applicable to the other layouts of multifunctional grooves shown in FIGS. 8A through 10C.

Figure 10A:
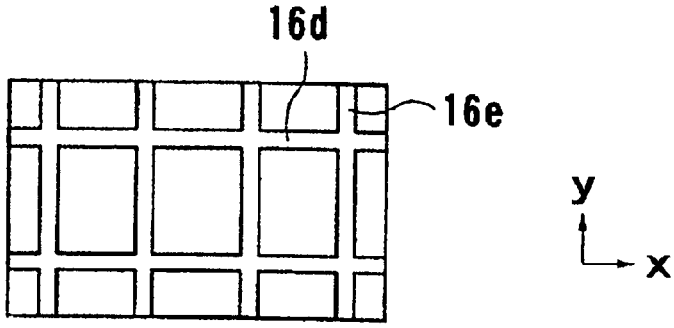
FIG. 10A is a plan view of still another polishing surface having a plurality of multifunctional grooves formed therein.

FIG. 10A shows a plurality of (two) multifunctional grooves 16*d* formed in a polishing surface at equal intervals and extending along the x axis and a plurality of (four) multifunctional grooves 16*e* formed in the polishing surface at equal intervals and extending along the y axis.

Figure 10B:
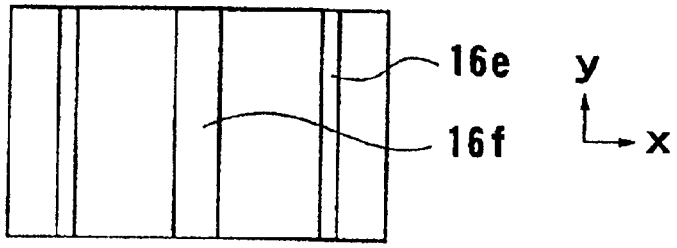
FIG. 10B is a plan view of yet another polishing surface having a plurality of multifunctional grooves formed therein.

FIG. 10B shows a plurality of (three) multifunctional grooves 16*e*, 16*f* formed in a polishing surface. The multifunctional grooves 16*e*, 16*f* extend along the y axis, and have different widths. Specifically, the two multifunctional grooves 16*e*, disposed one on each side of the central multifunctional groove 16*f*, are narrower than the central multifunctional groove 16*f*.

Figure 10C:
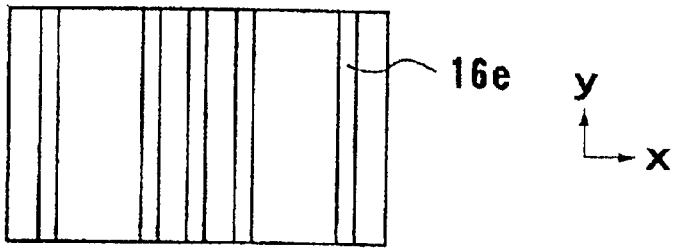
FIG. 10C is a plan view of yet still another polishing surface having a plurality of multifunctional grooves formed therein.

FIG. 10C shows a plurality of (five) multifunctional grooves 16*e* formed in a polishing surface. The multifunctional grooves 16*e* extend along the y axis, and are positioned at different densities. The three central multifunctional grooves 16*e*, which are located between the other two multifunctional grooves 16*e* located adjacent to ends of the polishing surface, are positioned more closely to each other than the two multifunctional grooves 16*e* on the opposite sides.

Since the polishing cloth or grinding stone at the central region of the polishing surface tends to lose its shape more easily than the other region thereof, the multifunctional groove 16*f* for discharging ground-off material is made wider as shown in FIG. 10B or the central multifunctional grooves 16*e* for discharging ground-off material are positioned more closely to each other as shown in FIG. 10C.

The multifunctional grooves shown in FIGS. 8A through 10C may be of the same shape and layout on the polishing surfaces 14, 15, or may be of different shapes and layouts depending on the type of the polishing surface.

The multifunctional grooves that are of different shapes and densities in the central and side regions of the polishing surface allow the polishing surface to be worn uniformly.

In the linear polishing apparatus 100, the polishing surface is used to different degrees and ground-off material is produced from the workpiece in different quantities, depending on the manner in which the polishing surface is moved. Therefore, appropriate shapes and layouts of the multifunctional grooves are not necessarily uniform over the entire polishing surface. The provision of the different groove shapes and layouts described above allows the polishing apparatus to have suitable multifunctional grooves for the polishing surface.

Figure 11A:
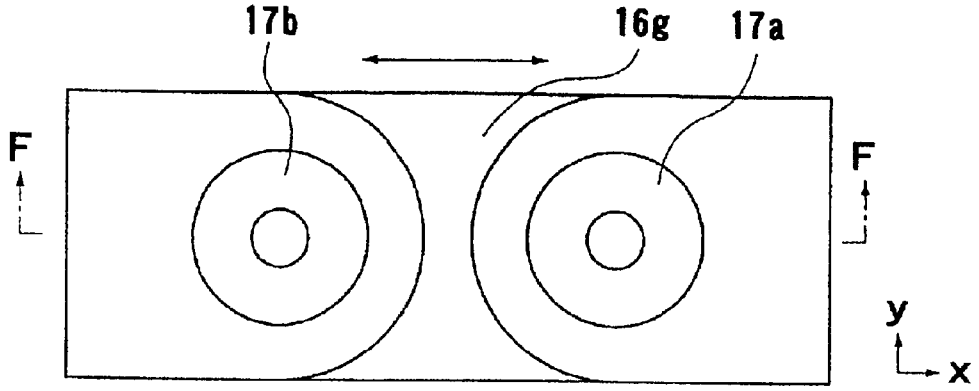
FIG. 11A is a plan view of a polishing surface having another multifunctional groove.
Figure 11B:
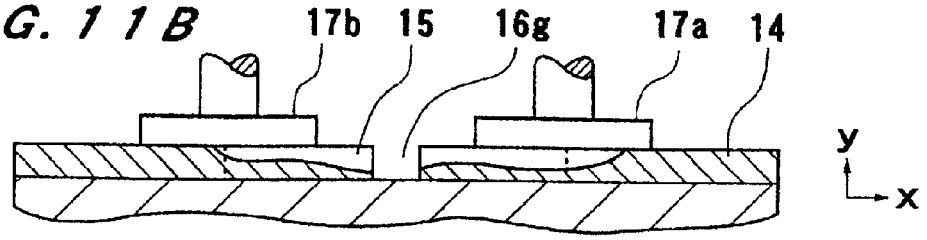
FIG. 11B is a cross-sectional view taken along line F—F of FIG. 11A.

Other multifunctional grooves will be described below with reference to FIGS. 11A through 11C. In FIGS. 11A and 11B, a multifunctional groove 16*g* which separates two polishing surfaces from each other is formed by round edges concentric with circular top rings 17*a*, 17*b* when the top rings 17*a*, 17*b* are in a normal position. This arrangement allows ground-off material to be discharged with ease because the distance between the edges of the multifunctional groove 16g and the outer peripheries of the top rings 17*a*, 17*b* remains substantially uniform.

Figure 11C:
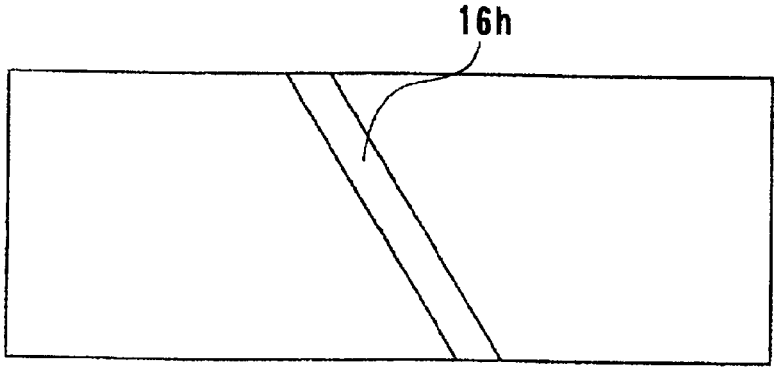
FIG. 11C is a plan view of a polishing surface having still another multifunctional groove.

In FIG. 11C, a multifunctional groove 16h which separates two polishing surfaces from each other is inclined at an angle of about 30° to the y axis. The inclined multifunctional groove 16*h* allows the polishing liquid to flow easily therein.

Figure 12:
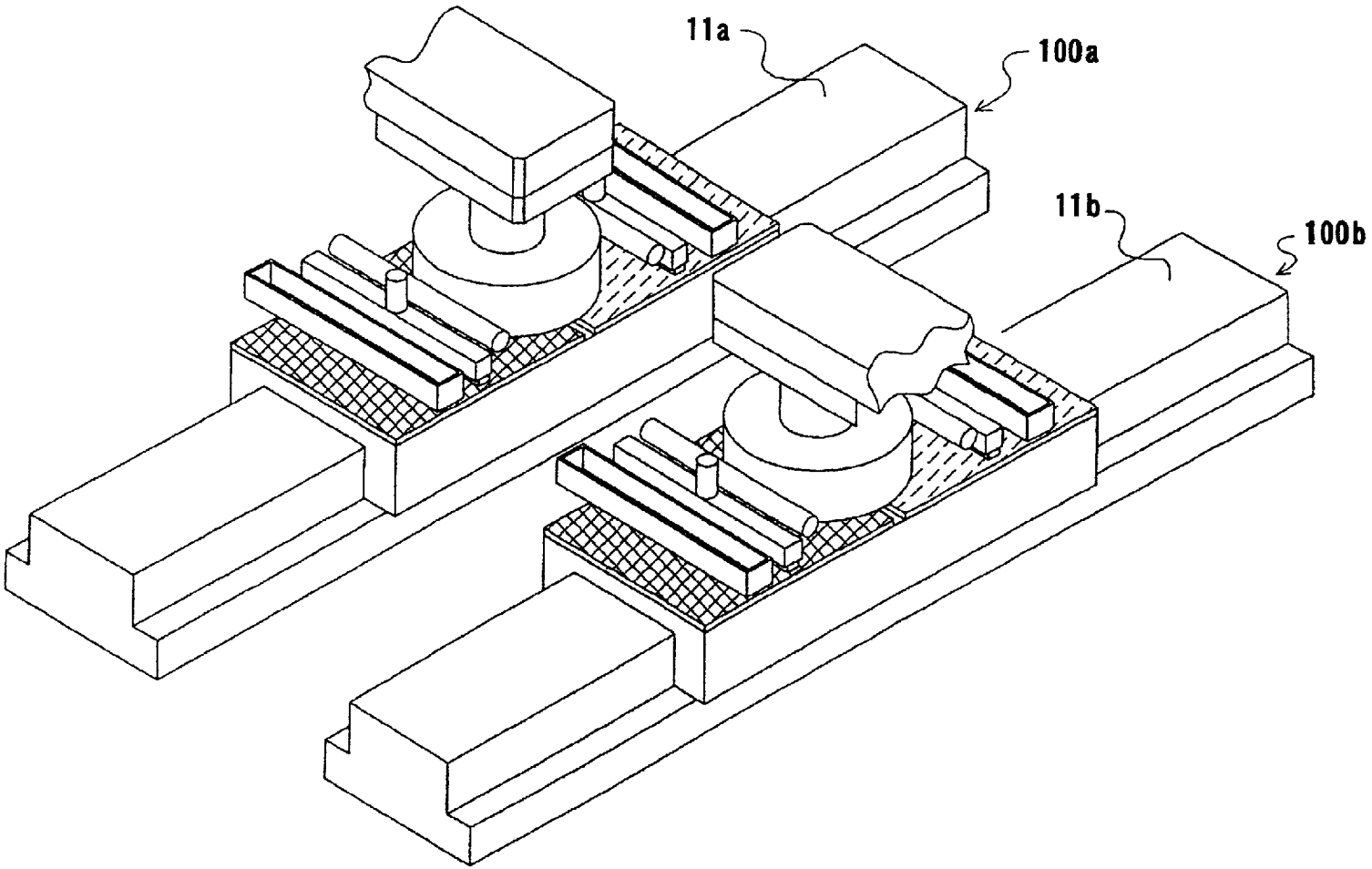
FIG. 12 is a perspective view of a polishing apparatus according to a second embodiment of the present invention.

FIG. 12 shows in perspective a polishing apparatus according to a second embodiment of the present invention. As shown in FIG. 12, the polishing apparatus has two polishing units 100*a*, 100*b* having respective guide rails 11*a*, 11*b* extending parallel to each other. Since the polishing units 100*a*, 100*b* are of an elongate rectangular shape as a whole, the number of polishing units can be increased more efficiently, compared with the polishing apparatus having a circular turntable, and the processing capability of the polishing apparatus per unit installation area can be increased. The polishing apparatus may have three or more polishing units for a further increased processing capability.

In the above embodiments, the guide rails are installed horizontally. However, the guide rail 11 of the polishing apparatus 100 may be oriented vertically such that the x axis is directed vertically. Since the thickness of the polishing apparatus 100 in a direction of the z axis is relatively small, the vertically oriented guide rail 11 allows the polishing apparatus to take up a greatly reduced installation area. The polishing units 100*a*, 100*b* may also be oriented vertically for a greatly increased processing capability per unit installation area.

Figure 13:
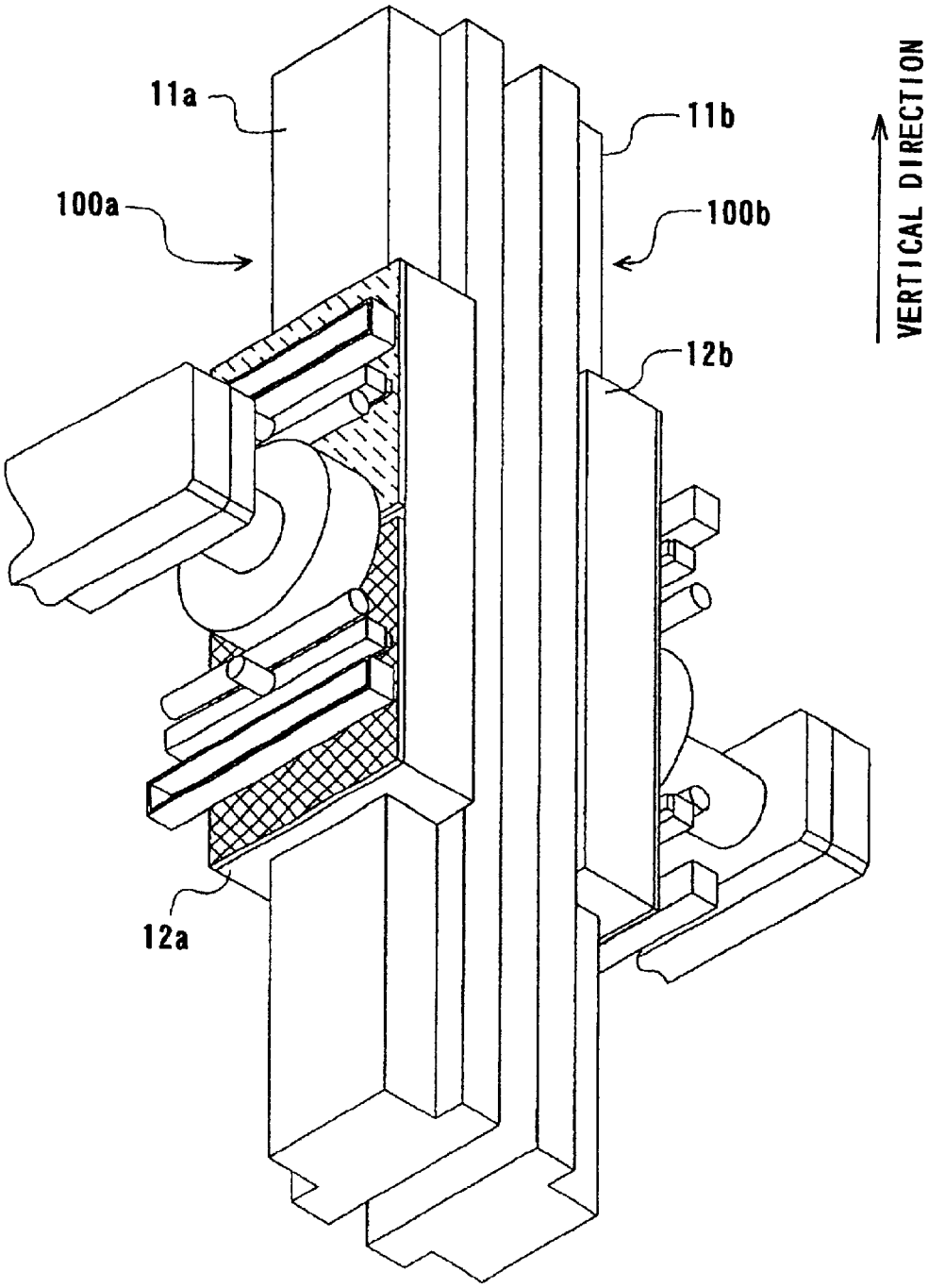
FIG. 13 is a perspective view of a polishing apparatus according to a third embodiment of the present invention.

FIG. 13 shows a polishing apparatus according to a third embodiment of the present invention. As shown in FIG. 13, the polishing apparatus has two polishing units 100*a*, 100*b* with respective guide rails 11*a*, 11*b* oriented vertically, and the polishing units 100*a*, 100*b* are positioned in a back-to-back relationship. The back-to-back relationship means that the guide rails 11*a*, 11*b* have their backsides held against each other, and polishing tables 12*a*, 12*b* are slidable on the front surfaces of the guide rails 11*a*, 11*b* which are remote from each other. The two guide rails 11*a*, 11*b* may be integrally formed with each other. In this case, the polishing tables 12*a*, 12*b* reciprocate linearly in a vertical direction along the guide rails 11*a*, 11*b* in a back-to-back relationship. This arrangement shown in FIG. 13 realizes space-saving and exhibits good maintenance property.

Figure 14:
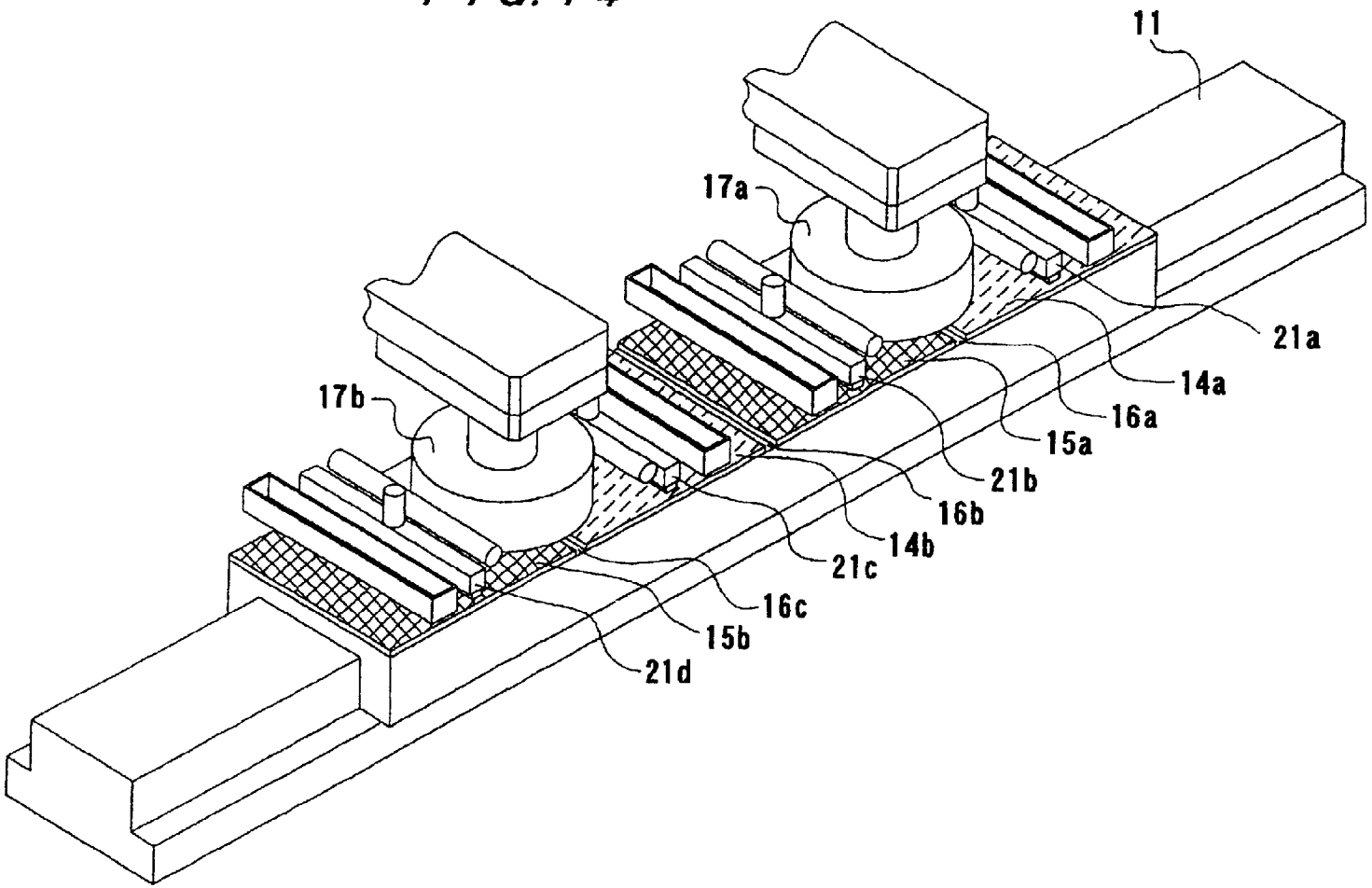
FIG. 14 is a perspective view of a polishing apparatus according to a fourth embodiment of the present invention.

FIG. 14 shows a polishing apparatus according to a fourth embodiment of the present invention. As shown in FIG. 14, the polishing apparatus comprises two top rings 17*a*, 17*b*, four dressers 21*a*, 21*b*, 21*c* and 21*d*, two pairs of different polishing surfaces 14*a*, 14*b* and 15*a*, 15*b* with three multifunctional grooves 16*a*, 16*b* and 16*c*, on one guide rail 11. This arrangement shown in FIG. 14 allows the polishing apparatus to have an increased processing capability per unit installation area.

Figure 15:
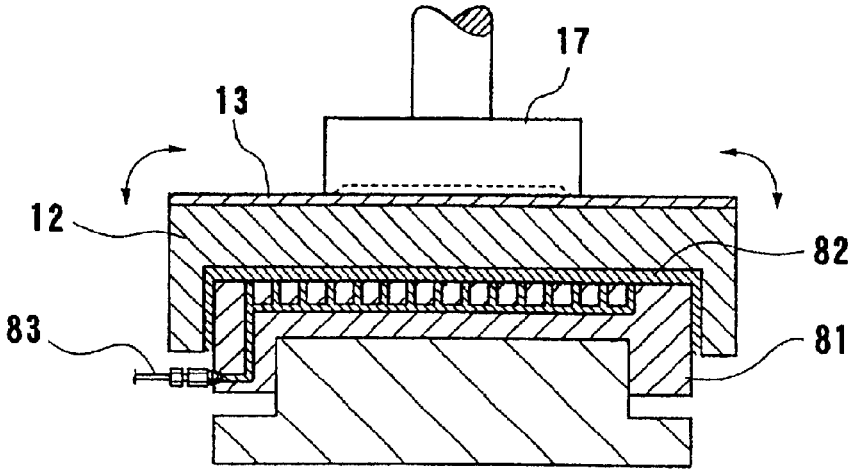
FIG. 15 is a cross-sectional view of a structure for supporting a polishing table on a guide rail under a fluid pressure.

FIG. 15 shows a structure for supporting a polishing table 12 on a guide rail under a fluid pressure. The guide rail is shown in a transverse cross section. In FIG. 15, the guide rail comprises a base 81 that is spaced from the polishing table 12 by a gap 82. The gap 82 is supplied with a fluid 83 whose pressure is controlled by an electro-pneumatic regulator (not shown) to cause the polishing table 12 to float over the base 81. Since the polishing table 12 is supported in a floating state, the attitude or posture of the polishing table 12 is changed depending on the fluid pressure applied to the polishing table 12. This floating of the polishing table 12 eliminates slight misalignments of the polishing surface 13 from the top ring 17 for thereby polishing the workpiece with increased uniformity.

The polishing table 12 which floats over the base 81 is linearly moved by a linear motor (not shown).

While the process of controlling the linear motor will be described later on, the control current to energize the linear motor varies depending on the loads imposed by the mechanism which is actuated by the linear motor. The greater the loads, the larger the control current. The frictional resistance during polishing, which is one of the loads, varies depending on the status of the polished surface of the workpiece. For this reason, the end point of the polishing process can be detected from the measured value of the control current to energize the linear motor. Similarly, the frictional resistance applied in the dressing process also varies depending on the status of the dressed polishing surface. Thus, the end point of the dressing process can be detected from the measured value of the control current supplied to actuate the dresser.

A polishing system incorporating a linear polishing apparatus according to the present invention will be described below with reference to FIG. 16. The polishing system in FIG. 16 is arranged to polish semiconductor wafers.

Figure 16:
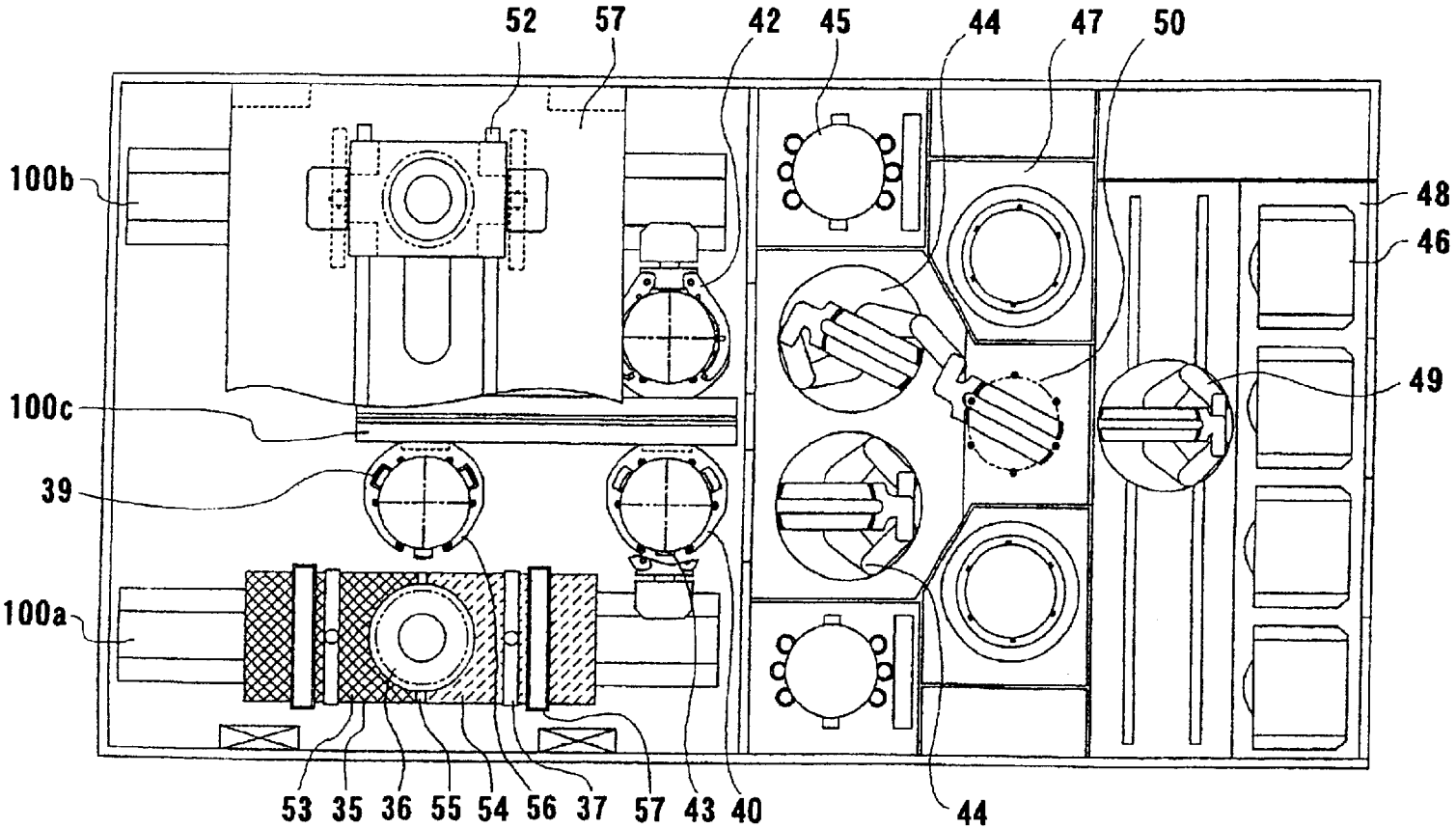
FIG. 16 is a plan view of a linear polishing apparatus as a polishing apparatus according to the present invention.

As shown in FIG. 16, the polishing system has two symmetrical linear polishing tables. For an increased processing capability, the linear polishing tables have respective wafer transferring mechanisms, and are capable of polishing semiconductor wafers simultaneously and independently of each other. Specifically, the polishing system comprises sets of a reversing machine 42, an upper linear transporter 40, a lifter 43, a lower linear transporter 56, and a pusher 39 that are axially symmetrically with respect to a linear transfer line 100*c*. Some of these components are omitted from illustration in FIG. 16.

The polishing system has four cassette stages 48 as a table for placing cassettes 46 housing semiconductor wafers W (not shown) therein. A double-armed transfer robot 49 takes out a semiconductor wafer from one of the cassettes 46 on the cassette stages 48, and transfers the semiconductor wafer to a wafer station 50 where the semiconductor wafer is placed.

Water-resistant double-armed transfer robots 44 transfer the semiconductor wafer from the wafer station 50 to the respective reversing machines 42 which turn the semiconductor wafer upside down while holding the semiconductor wafer. The semiconductor wafer reversed by the reversing machine 42 has its patterned surface directed downwardly. The lifter 43, which is disposed below the reversing machine 42, receives the semiconductor wafer from the reversing machine 42. When the lifter 43 holding the semiconductor wafer is lowered, it transfers the semiconductor wafer to the upper linear transporter 40 that has been waiting below the lifter 43. There are provided two linear transporters on the same transfer line, i.e. the upper linear transporter 40 and the lower linear transporter 56, each having a horizontally movable shaft, which are movable independently of each other.

After transferring the semiconductor wafer, the lifter 43 is further lowered away from the transfer surface of the upper linear transporter 40. The upper linear transporter 40 transports the semiconductor wafer to the position of the pusher 39 which has been waiting below the lower linear transporter 56. When the centers of the top ring 36, the pusher 39, and the upper linear transporter 40 holding the semiconductor wafer are aligned with each other, the pusher 39 is raised to transfer the semiconductor wafer from the upper linear transporter 40 to the top ring 36. At this time, the top ring 36 has been moved to the position of the pusher 39 by a horizontal moving mechanism 52 disposed on a stage higher than the polishing surface.

The top ring 36 which has attracted the semiconductor wafer under vacuum is moved toward a polishing table 35. The polishing table 35 reciprocates linearly at a maximum speed of about 2 m per second. The polishing table 35 can carry polishing surfaces of different types. In this embodiment, the polishing table 35 includes a portion carrying a polishing surface which comprises a resilient polishing pad 53 and a portion carrying a polishing surface which comprises a fixed abrasive 54. The polishing surfaces of different types provide different polishing characteristics. By utilizing this characteristics, after the semiconductor wafer is roughly polished by the fixed abrasive having a high polishing rate, the semiconductor wafer is finish-polished by the polishing pad having a low polishing rate and a high polishing accuracy. In this manner, it is possible to achieve a high polishing rate and a high polishing accuracy which are contrary to each other. A multifunctional groove 55 is formed between the different polishing surfaces to prevent different polishing liquids and ground-off materials from being mixed with each other.

Elongate rectangular dressers 37 are disposed one on each side of the top ring 36. Each of the dressers 37 is combined with a lifting and lowering mechanism, a mechanism for moving the dresser 37 in a longitudinal direction thereof, a nozzle disposed in the dresser 37 for preventing the dresser 37 from being dried, and a dresser receptacle 57 for receiving a liquid dropping from the dresser 37. The dresser 37 presses a dresser element such as diamond particles against polishing surfaces 53, 54 for thereby dressing the polishing surfaces 53, 54, removing clogging of the polishing surfaces 53, 54, and cleaning the polishing surfaces 53, 54.

The lifting and lowering mechanism has a shaft attached obliquely, but not perpendicularly, to the polishing table 35. This inclined shaft allows the dresser 37 to move vertically and laterally to the dresser receptacle 57 along one axis. In other words, movement of one axis doubles movements of two axes. When the dresser 37 is lifted obliquely, the dresser receptacle 57 is positioned below the dresser 37. The liquid which is discharged from the dresser nozzle to prevent the dresser 37 from being dried is received in its entirety by the dresser receptacle 57 for thereby preventing the rinsing liquid from adversely affecting the polishing surfaces 53, 54, e.g. preventing the rinsing liquid from diluting the slurry on the polishing surfaces 53, 54.

The top ring 36 holds the semiconductor wafer and presses the semiconductor wafer against the fixed abrasive 54, for rough polishing, which reciprocates linearly. For polishing the semiconductor wafer with the fixed abrasive 54, the polishing table 35 is moved in a range that is limited to the range of the fixed abrasive 54 with respect to the top ring 36. The fixed abrasive 54 and the polishing table 35 have a plurality of holes having a diameter of about 2 mm for supplying the polishing liquid directly to an interface between the semiconductor wafer and the fixed abrasive grain 54. The end point of the rough polishing process is determined by a polishing judgement unit.

The top ring 35 is lifted while carrying the semiconductor wafer which has been roughly polished. Then, the polishing surface of the polishing pad 53 for finish-polishing is moved to a position below the top ring 36, and polishes the semiconductor wafer in a finishing fashion. The end point of the finish-polishing process is also determined by the polishing judgement unit.

When the rough polishing process and the finish-polishing process are completed, the top ring 36 which is carrying the semiconductor wafer is moved to the position of the pusher 39, and transfers the semiconductor wafer to the pusher 39. While the top ring 36 is carrying out a series of actions to transfer the semiconductor wafer, the polishing surfaces of the polishing pad 53 and the fixed abrasive 54 are dressed by the respective dressers 37. Since the dressers 37 are positioned near the centers of the respective polishing surfaces, the polishing surfaces can simultaneously be dressed. In order to prevent foreign matter discharged from the polishing table 35 from moving to the other polishing surface in the dressing process, the foreign matter is forcibly discharged from the multifunctional groove 55 under vacuum.

After the pusher 39 receives the semiconductor wafer, the pusher 39 transfers the semiconductor wafer to the lower linear transporter 56 when it is lowered. At this time, the upper linear transporter 40 is waiting near the transfer robot 44 in such a state that the upper linear transporter 40 has received the semiconductor wafer from the transfer robot 44. When the lower linear transporter 56 starts moving toward the transfer robot 44, the upper linear transporter 40 moves toward the pusher 39, and transfers the semiconductor wafer to the top ring 36 in the same sequence as described above.

The semiconductor wafer is delivered from the lower linear transporter 56 to the reversing machine 42 by upward movement of the lifter 43. The reversing machine 42 turns the received semiconductor wafer upside down. The transfer robot 44 receives the semiconductor wafer from the reversing machine 42, and transfers the semiconductor wafer successively to a primary cleaning unit 45 and a secondary cleaning unit 47. It is possible to transfer the semiconductor wafer between two transfer robots 44 using the wafer station 50 and combine the polishing process and the cleaning process freely to be carried out on one semiconductor wafer. For example, the semiconductor wafer may be polished on one of the polishing tables, and then cleaned by the primary cleaning unit. Thereafter, the semiconductor wafer may be transferred to the other of the polishing tables via the wafer station 50, polished on the other polishing table under different conditions, and then cleaned by the primary and secondary cleaning units.

The semiconductor wafer is finally dried by the secondary cleaning unit 47. The dried semiconductor wafer is transferred by the transfer robot 49 to the cassette 46 from which it was unloaded, and processing of the semiconductor wafer is now completed.

Drive mechanisms suitable for causing the polishing table, the top ring, and the dressers to make linear reciprocating motion will be described below with reference to FIGS. 17 through 22.

FIG. 17 shows general characteristics of linear motors. As shown in FIG. 17, a linear induction motor LIM is suitable for large-output, medium-speed and high-speed transport applications. A linear DC motor LDM is excellent for small-displacement, and high-speed positional control applications. A linear pulse motor LPM is excellent for low-speed, high-propulsion, intermittent transport, positional control applications. Therefore, these linear motors can be used to cause the polishing table, the top ring, and the dressers to make linear reciprocating motion.

Figure 18:
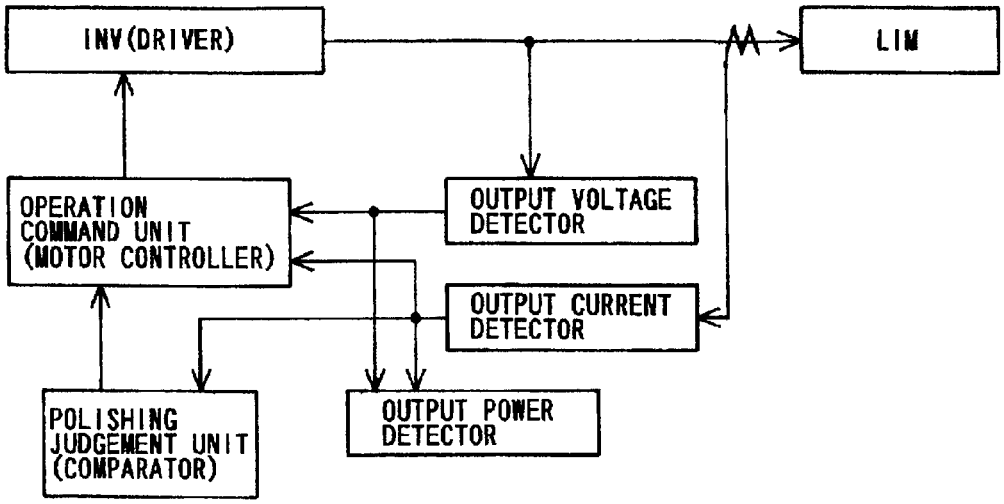
FIG. 18 is a block diagram of a control system for controlling a linear induction motor.

A control system for controlling the linear induction motor LIM will be described below with reference to FIG. 18. In FIG. 18, an output signal from an INV (driver) is applied to the linear induction motor LIM to energize the linear induction motor LIM.

An output voltage and an output current from the INV are applied respectively to an output voltage detector and an output current detector which detect the output voltage and the output current, and output the detected values to an operation command unit (motor controller), an output power detector, and a polishing judgement unit (comparator).

Figure 19A:
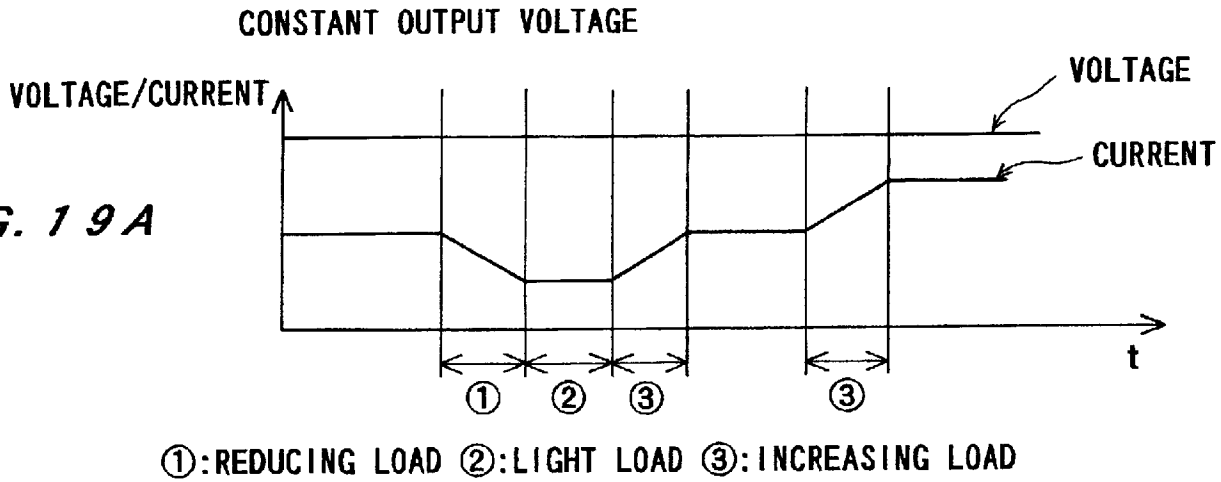
FIGS. 19A and 19B are diagrams showing time vs. current/voltage charts showing a process of controlling the linear induction motor.
Figure 19B:
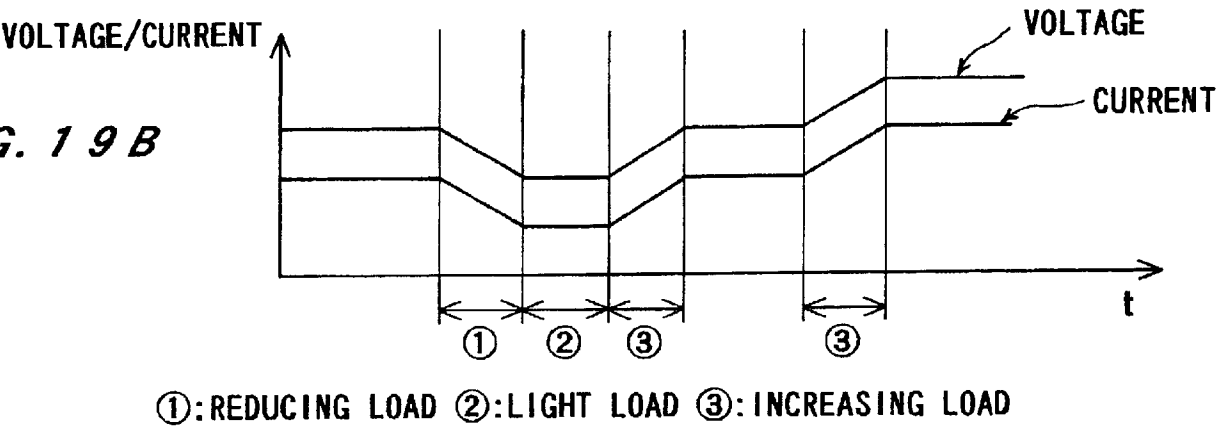

FIGS. 19A and 19B show time vs. current/voltage charts showing a process of controlling the linear induction motor LIM. As shown in FIG. 19A, when the output frequency and the output voltage are constant, the signal from the output voltage detector is fed back to the operation command unit to keep the INV output voltage constant. At this time, a current flows as an INV output current depending on the load, the output current and power of the INV change, and the polishing judgement unit can determine the completion of the polishing process based on the change of the output current and power of the INV.

As shown in FIG. 19B, when the output frequency and the output voltage are variable, the signals from the output voltage detector and the output current detector are fed back to the operation command unit to change the INV output voltage, thereby controlling the power factor (slippage and speed) to be substantially constant and outputting a voltage and a current depending on the load. Since the voltage and the current are outputted depending on the load as the INV output, the output current and power of the INV change, and the polishing judgement unit can determine the completion of the polishing process based on the change of the output current and power of the INV.

Although not shown in the drawing, a speed detector may be provided to control the slippage of the induction motor constant.

Figure 20:
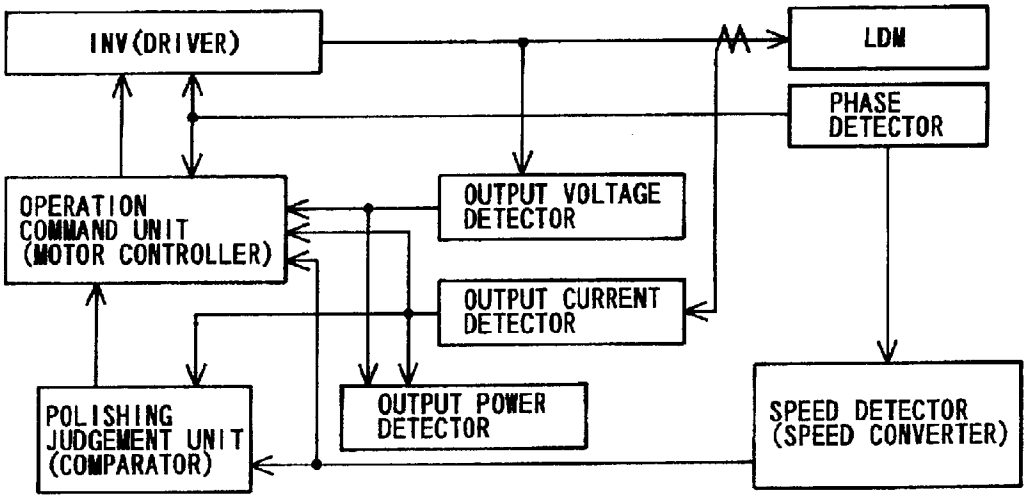
FIG. 20 is a block diagram of a control system for controlling a linear DC motor.

A control system for controlling the linear DC motor LDM will be described below with reference to FIG. 20. In FIG. 20, an output signal from an INV (driver) is applied to the linear DC motor LDM to energize the linear DC motor LDM.

An output voltage and an output current from the INV are applied respectively to an output voltage detector and an output current detector which detect the output voltage and the output current, and output the detected values to an operation command unit (motor controller), an output power detector, and a polishing judgement unit (comparator).

The speed of the DC motor is determined by the output voltage. If the DC motor is to be operated at a constant speed, the signals from the output voltage detector, a phase detector, and a speed detector are fed back to the operation command unit to control the output voltage of the INV to be constant, thus keeping the speed of the DC motor constant.

Figure 21A:
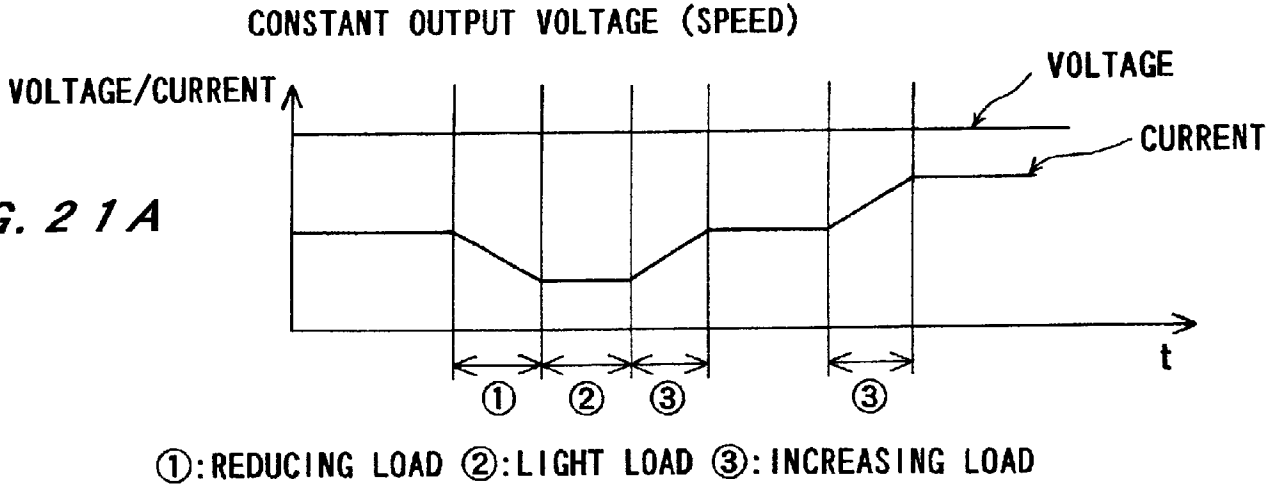
FIGS. 21A and 21B are diagrams showing time vs. current/voltage charts showing a process of controlling the linear DC motor.

At this time, as shown in FIG. 21A, a current flows depending on the load as the output from the IVN, the output voltage, current, and power of the INV change, and the polishing judgement unit can determine the completion of the polishing process based on the change of the output voltage, current and power of the INV.

Figure 21B:
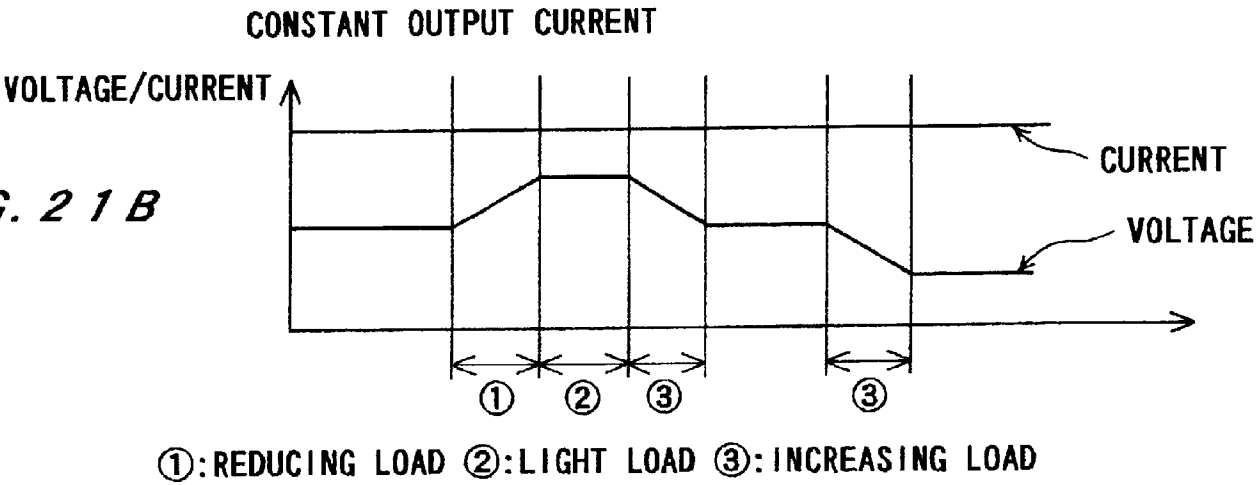

As shown in FIG. 21B, if the output current is constant, the signals from the output voltage detector and the output current detector and the speed signal are fed back to the operation command unit to change the output voltage of the INV, thereby controlling the current (torque) to be substantially constant and outputting a voltage and current depending on the load.

At this time, since a voltage and power are outputted depending on the load as the output from the IVN, the output voltage and power of the INV change, and the polishing judgement unit can determine the completion of the polishing process based on the change of the output voltage and power of the INV. Since the speed changes when the output voltage changes, the polishing judgement unit can determine the completion of the polishing process based on the signal from the speed detector.

An air pressure actuating system for making linear reciprocating motion will be described below with reference to FIG. 22.

Figure 22:
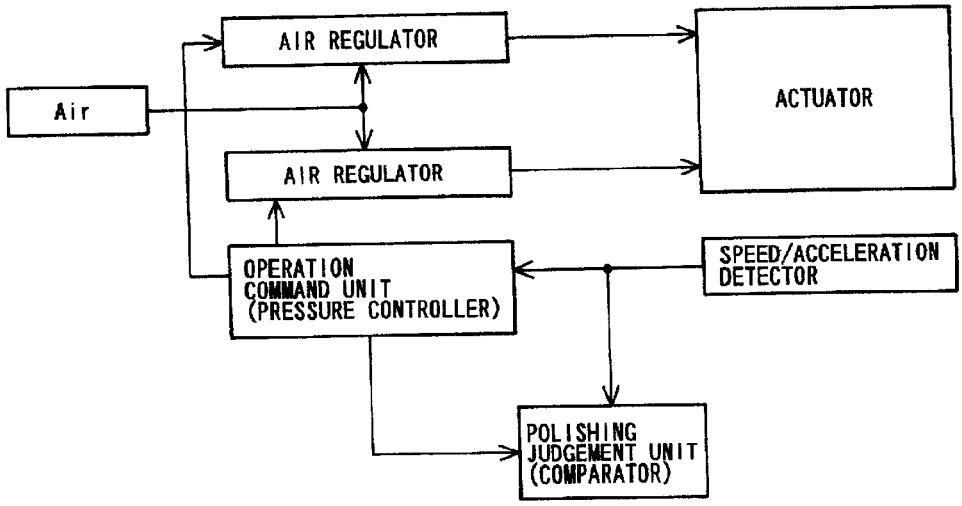
FIG. 22 is a block diagram of an air pressure actuating system for making linear reciprocating motion.
Figure 23:
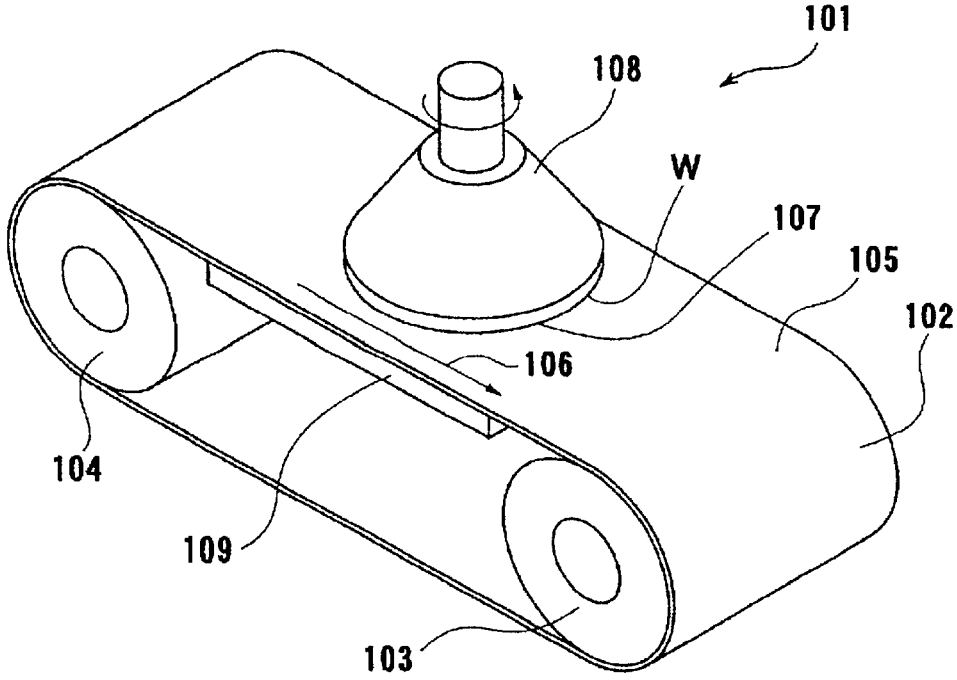
FIG. 23 is a perspective view of a conventional polishing apparatus.

As shown in FIG. 22, air regulated by two air regulators is supplied to a single actuator. The two air regulators are supplied with air from an air source. Each of the air actuators is linked with a speed/acceleration detector which sends a detected signal to an operation command unit (pressure controller). Output signals from the operation command unit are transmitted to the two air regulators to control the speed or acceleration of the actuator to be constant.

Since the speed/acceleration of linear reciprocating motion of the actuator changes depending on the load in the polishing process, the detected signals from the speed/acceleration detectors may be transmitted to a polishing judgement unit (comparator) to determine the completion of the polishing process.

According to the present invention, the polishing table is movable relatively to the top ring for polishing the workpiece held by the top ring, and at least one of the top ring and the polishing table reciprocates linearly in the first direction, and hence the workpiece can be polished uniformly.

Although certain preferred embodiments of the present invention have been shown and described in detail, it should be understood that various changes and modifications may be made therein without departing from the scope of the appended claims.

What is claimed is:

1. A polishing apparatus comprising:

a top ring for holding a workpiece to be polished;

a polishing table linearly movable relatively to said top ring, said polishing table having a polishing surface for polishing the workpiece held by said top ring, at least one of said top ring and said polishing table reciprocating linearly in a first direction; and dressers disposed on both sides of said top ring along said first direction for dressing said polishing surface.

2. A polishing apparatus according to claim 1, further comprising a polishing liquid supply device for supplying a polishing liquid to said polishing surface.

3. A polishing apparatus according to claim 1, wherein said dressers reciprocate linearly in a second direction for dressing said polishing surface.

4. A polishing apparatus according to claim 1, wherein said top ring reciprocates linearly in a third direction intersecting said first direction.

5. A polishing apparatus according to claim 1, wherein said top ring is rotatable about its axis.

6. A polishing apparatus according to claim 1, wherein said polishing surface has a groove formed therein for discharging a waste material from said polishing surface.

7. A polishing apparatus according to claim 1, wherein said polishing table has a plurality of polishing surfaces having different levels of coarseness.

8. A polishing apparatus according to claim 1, further comprising a linear motor for reciprocating said at least one of said top ring and said polishing table linearly in said first direction.

9. A polishing apparatus according to claim 1, wherein said polishing table is arranged to reciprocate linearly in said first direction, and supported by a linear guide under a fluid pressure.

10. The polishing apparatus of claim 1, wherein said dressers are positioned symmetrically with respect to said top ring.

11. A polishing apparatus, comprising:

a top ring for holding a workpiece to be polished;

a linear guide;

a polishing table mounted on said linear guide so as to be capable of being linearly reciprocated along said linear guide in a first direction and so as to be reciprocable with respect to said top ring;

at least one polishing pad fixed on said polishing table for polishing the workpiece held by said top ring; and dressers disposed on both sides of said top ring along said first direction for dressing said polishing surface.

12. The polishing apparatus of claim 11, wherein said linear guide comprises a linear guide rail having a horizontal guide surface upon which said polishing table is mounted.

13. The polishing apparatus of claim 11, wherein said at least one polishing pad fixed on said polishing table comprises a fixed abrasive.

14. The polishing apparatus of claim 11, wherein said dressers are positioned symmetrically with respect to said top ring.

* * * * *